US009349529B2

(12) United States Patent
Matsuda et al.

(10) Patent No.: US 9,349,529 B2
(45) Date of Patent: May 24, 2016

(54) TAP CHANGER

(71) Applicant: Mitsubishi Electric Corporation, Chiyoda-ku (JP)

(72) Inventors: Tetsuya Matsuda, Chiyoda-ku (JP); Kesaaki Yamaguchi, Chiyoda-ku (JP); Yukinori Ikeda, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 262 days.

(21) Appl. No.: 14/016,574

(22) Filed: Sep. 3, 2013

(65) Prior Publication Data

US 2014/0216902 A1 Aug. 7, 2014

(30) Foreign Application Priority Data

Feb. 7, 2013 (JP) ..... 2013-022399

(51) Int. Cl.

| | |
|---|---|
| ***H01H 19/00*** | (2006.01) |
| ***H01H 21/00*** | (2006.01) |
| ***H01F 29/04*** | (2006.01) |
| ***H01H 1/56*** | (2006.01) |
| ***H01H 1/62*** | (2006.01) |
| ***H01H 9/00*** | (2006.01) |

(52) U.S. Cl.

CPC ..... *H01F 29/04* (2013.01); *H01H 1/56* (2013.01); *H01H 1/62* (2013.01); *H01H 9/0016* (2013.01)

(58) Field of Classification Search

CPC ..... H01F 29/04; H01F 29/02; H01F 30/12; H01H 1/62; H01H 9/0016; H01H 1/56

See application file for complete search history.

(56) References Cited

U.S. PATENT DOCUMENTS 2,435,438 A * 2/1948 Fowler ..... 200/6 R
5,153,399 A * 10/1992 Schaffer et al. ..... 218/63

FOREIGN PATENT DOCUMENTS

| | | | |
|---|---|---|---|
| CN | 1314684 | A | 9/2001 |
| CN | 102623155 | A | 8/2012 |
| EP | 0 391 325 | A1 | 10/1990 |

(Continued)

OTHER PUBLICATIONS

Office Action issued Mar. 24, 2015 in Japanese Patent Application No. 2013-022399 (with English language translation).

(Continued)

*Primary Examiner* — Renee Luebke
*Assistant Examiner* — Lheiren Mae A Caroc
(74) *Attorney, Agent, or Firm* — Oblon, McClelland, Maier & Neustadt, L.L.P

(57) ABSTRACT

In an end-side tap changing mechanism group of a plurality of tap changing mechanism groups that is located at an end of a rotation shaft, input connection points between a plurality of fixed contact connection members and a plurality of input conductors, respectively, are located closer in a shaft direction of the rotation shaft to a center line of entire the plurality of tap changing mechanism groups than a center line of the end-side tap changing mechanism group, and an output connection point between a stator connection member and an output conductor is located closer in the shaft direction of the rotation shaft to the center line of entire the plurality of tap changing mechanism groups than the center line of the end-side tap changing mechanism group.

4 Claims, 14 Drawing Sheets

(56) References Cited

FOREIGN PATENT DOCUMENTS

| | | | |
|---|---|---|---|
| JP | 59-112921 | U | 7/1984 |
| JP | 3-230506 | A | 10/1991 |
| JP | 7-86058 | A | 3/1995 |
| JP | 2007-258393 | | 10/2007 |
| JP | 2011-9432 | A | 1/2011 |

OTHER PUBLICATIONS

Combined Chinese Office Action and Search Report issued Jul. 3, 2015 in Patent Application No. 201310501561.5 (with partial English language translation and English translation of categories of cited documents).

* cited by examiner

TAP CHANGER

BACKGROUND OF THE INVENTION

1. Field of the Invention

The present invention relates to a tap changer, and particularly to a tap changer changing a tap of a connected transformer during no load condition.

2. Description of the Background Art

Japanese Patent Laying-Open No. 2007-258393 is provided as a prior art document disclosing a tap changer for a load condition that allows reduction of eddy current loss occurring in a lead-through portion of a drive mechanism to alleviate current limitation due to the eddy current loss.

In the tap changer for a load condition disclosed in Japanese Patent Laying-Open No. 2007-258393, a connection lead between a changeover switch and a tap selector is formed of a connection lead on the odd-number side and a connection lead on the even-number side.

The connection lead on the odd-number side is formed of an upper drawn lead that is drawn from an annular contact on the odd-number side to extend upward and connected to the terminal on the odd-number side of the changeover switch; and a lower drawn connection lead that is drawn from an annular contact on the odd-number side to extend downward and connected to the terminal on the odd-number side of the changeover switch. The connection lead on the even-number side is formed of an upper drawn connection lead that is drawn to extend upward and a lower drawn connection lead that is drawn to extend downward.

By forming the connection leads on the odd-number side and the even-number side from two parallel leads including an upper drawn lead and a lower drawn lead, the current flowing through each of the upper and lower drive mechanisms can be reduced to half of the current in the case of the conventional technique, to suppress heat generation caused by eddy current loss.

By the eddy current generated within the tap changer, contact portions of the tap changer may be locally overheated.

SUMMARY OF THE INVENTION

An object of the present invention is to provide a tap changer that can suppress local overheating at a contact portion.

A tap changer according to the present invention includes a plurality of tap changing mechanism groups each having a plurality of tap changing mechanism units that are arranged at predetermined intervals in a shaft direction of a rotation shaft and electrically connected in parallel. The plurality of tap changing mechanism units each include an annular conductor having the center through which the rotation shaft passes; a plurality of fixed contacts located at predetermined intervals on a concentric circumference of the rotation shaft; a stator electrically connected to the annular conductor; a first sliding contact pivoting about the rotation shaft while being in sliding contact with the annular conductor; a second sliding contact pivoting about the rotation shaft to be capable of being in sliding contact with one of the plurality of fixed contacts; and a movable element pivoting about the rotation shaft together with the first sliding contact and the second sliding contact to be capable of electrically connecting the annular conductor and one of the plurality of fixed contacts. The plurality of tap changing mechanism groups each include a plurality of fixed contact connection members each electrically connecting the fixed contacts that are located at the same position on the concentric circumference as seen in the shaft direction of the rotation shaft in the plurality of tap changing mechanism units, a stator connection member electrically connecting the stators of the plurality of tap changing mechanism units, a plurality of input conductors electrically connected to the fixed contact connection members, respectively, and an output conductor electrically connected to the stator connection member. In an end-side tap changing mechanism group of the plurality of tap changing mechanism groups that is located at an end of the rotation shaft, input connection points between the plurality of fixed contact connection members and the plurality of input conductors, respectively, are located closer in the shaft direction of the rotation shaft to a center line of entire the plurality of tap changing mechanism groups than a center line of the end-side tap changing mechanism group, and an output connection point between the stator connection member and the output conductor is located closer in the shaft direction of the rotation shaft to the center line of entire the plurality of tap changing mechanism groups than the center line of the end-side tap changing mechanism group.

According to the present invention, local overheating at a contact portion can be suppressed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
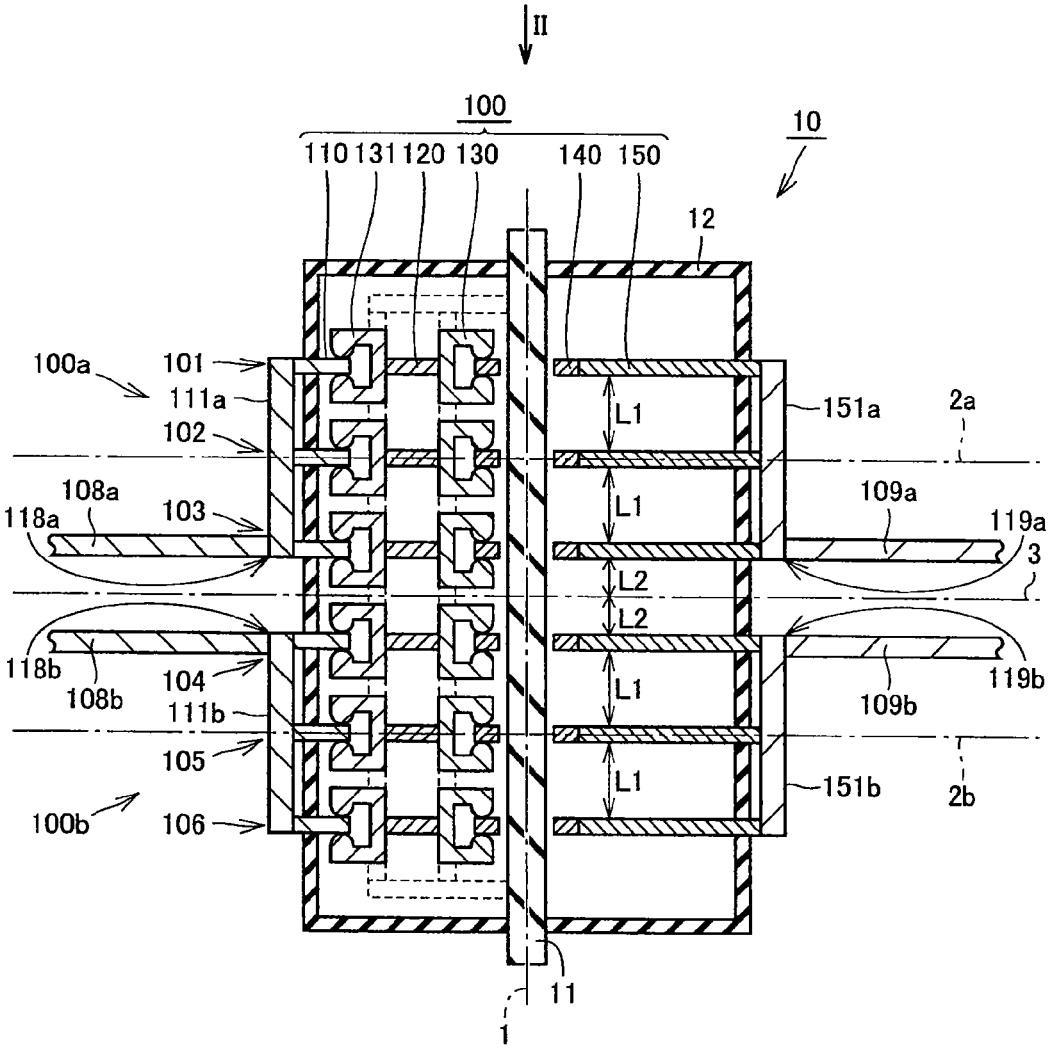
FIG. 1 is a cross-sectional view showing the configuration of a tap changer according to the first embodiment of the present invention.

A tap changer according to the first embodiment of the present invention will be hereinafter described with reference to the accompanying drawings, in which the same or corresponding components in each embodiment are designated by the same reference characters, and description thereof will not be repeated.

First Embodiment

Figure 2:
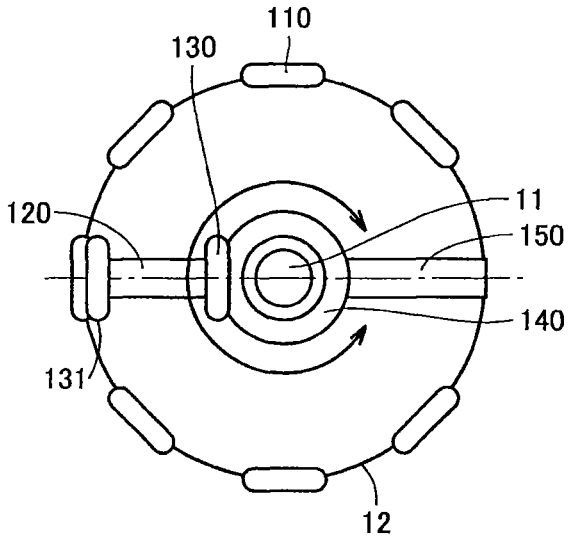
FIG. 2 is a diagram of a tap changing mechanism unit of the tap changer according to the first embodiment as seen in the direction indicated by an arrow II in FIG. 1.

FIG. 1 is a cross-sectional view showing the configuration of a tap changer according to the first embodiment of the present invention. FIG. 2 is a diagram of a tap changing mechanism unit of the tap changer according to the first embodiment as seen in the direction indicated by an arrow II in FIG. 1. A tap changer 10 according to the present embodiment serves as a tap changer changing a tap of the connected transformer during no load condition. FIG. 2 is a perspective view of an insulation tube 12.

As shown in FIGS. 1 and 2, tap changer 10 according to the first embodiment of the present invention includes a rotation shaft 11 made of a material having electrical insulation properties, and an insulation tube 12 disposed coaxially with rotation shaft 11 and made of a material having electrical insulation properties. Rotation shaft 11 is connected to a driving source (not shown) and capable of pivoting about its axis. Insulation tube 12 has a diameter of about 50 cm to 100 cm, for example.

Tap changer 10 according to the present embodiment includes two tap changing mechanism groups each having three tap changing mechanism units 100 that are arranged at predetermined intervals in a shaft direction 1 of rotation shaft 11 and electrically connected in parallel.

Specifically, tap changer 10 includes a one-end side tap changing mechanism group 100*a* located on one end side of rotation shaft 11 and the other-end side tap changing mechanism group 100*b* located on the other end side of rotation shaft 11.

One-end side tap changing mechanism group 100*a* includes a first tap changing mechanism unit 101, a second tap changing mechanism unit 102 and a third tap changing mechanism unit 103 that are arranged at regular intervals L1, starting from the one end side of rotation shaft 11 toward the middle thereof.

First tap changing mechanism unit 101, second tap changing mechanism unit 102 and third tap changing mechanism unit 103 are electrically connected in parallel by a plurality of fixed contact connection members 111*a* and a stator connection member 151*a*, which will be described later.

The other-end side tap changing mechanism group 100*b* includes a fourth tap changing mechanism unit 104, a fifth tap changing mechanism unit 105 and a sixth tap changing mechanism unit 106 that are arranged at predetermined intervals L1, starting from near the middle of rotation shaft 11 toward the other end thereof.

Fourth tap changing mechanism unit 104, fifth tap changing mechanism unit 105 and sixth tap changing mechanism unit 106 are electrically connected in parallel by a plurality of fixed contact connection members 111*b* and a stator connection member 151*b*, which will be described later.

Each of tap changing mechanism units 100 includes an annular conductor 140 having the center through which rotation shaft 11 passes; a plurality of fixed contacts 110 located at predetermined intervals on the concentric circumference of rotation shaft 11; a stator 150 electrically connected to annular conductor 140; a first sliding contact 130 pivoting about rotation shaft 11 while being in sliding contact with annular conductor 140; a second sliding contact 131 pivoting about rotation shaft 11 to be capable of being in sliding contact with one of the plurality of fixed contacts 110; and a movable element 120 pivoting about rotation shaft 11 together with first sliding contact 130 and second sliding contact 131 to be capable of electrically connecting annular conductor 140 and one of the plurality of fixed contacts 110.

Specifically, in tap changer 10, six annular conductors 140 are attached to rotation shaft 11 at predetermined intervals L1 from each other. Predetermined intervals L1 each are about 10 cm, for example. In order to prevent each annular conductor 140 from pivoting due to pivotal movement of rotation shaft 11, each annular conductor 140 is placed on a retaining ring attached to rotation shaft 11 and fixed so as to be in sliding contact with this retaining ring.

In the present embodiment, in each of tap changing mechanism units 100, seven fixed contacts 110 are arranged at regular intervals on the same circumference of insulation tube 12. Specifically, in the present embodiment, fixed contacts 110 are arranged 45 degrees apart on the circumference.

Fixed contact 110 of first tap changing mechanism unit 101, fixed contact 110 of second tap changing mechanism unit 102 and fixed contact 110 of third tap changing mechanism unit 103 that are located at the same position in the circumferential direction of insulation tube 12 as seen in shaft direction 1 of rotation shaft 11 are electrically connected by fixed contact connection member 111*a*.

Accordingly, one-end side tap changing mechanism group 100*a* includes seven fixed contact connection members 111*a*. Each fixed contact connection member 111*a* has a length equal to that linearly connecting fixed contact 110 of first tap changing mechanism unit 101 and fixed contact 110 of third tap changing mechanism unit 103.

Fixed contact 110 of fourth tap changing mechanism unit 104, fixed contact 110 of fifth tap changing mechanism unit 105 and fixed contact 110 of sixth tap changing mechanism unit 106 that are located at the same position in the circumferential direction of insulation tube 12 as seen in shaft direction 1 of rotation shaft 11 are electrically connected by fixed contact connection member 111*b*.

Accordingly, the other-end side tap changing mechanism group 100*b* includes seven fixed contact connection members 111*b*. Each fixed contact connection member 111*b* has a length equal to that linearly connecting fixed contact 110 of fourth tap changing mechanism unit 104 and fixed contact 110 of sixth tap changing mechanism unit 106.

Stator 150 is provided so as to extend from one end of annular conductor 140 to the outside of insulation tube 12 in the radial direction of insulation tube 12. Stator 150 extends to pass over the circumference of insulation tube 12 at which fixed contacts 110 are located.

Stator 150 of first tap changing mechanism unit 101, stator 150 of second tap changing mechanism unit 102 and stator 150 of third tap changing mechanism unit 103 are electrically connected by stator connection member 151*a*. Stator connection member 151*a* has a length equal to that linearly connecting stator 150 of first tap changing mechanism unit 101 and stator 150 of third tap changing mechanism unit 103.

Stator 150 of fourth tap changing mechanism unit 104, stator 150 of fifth tap changing mechanism unit 105 and stator 150 of sixth tap changing mechanism unit 106 are electrically connected by stator connection member 151*b*. Stator connection member 151*b* has a length equal to that linearly connecting stator 150 of fourth tap changing mechanism unit 104 and stator 150 of sixth tap changing mechanism unit 106.

First sliding contact 130 has a pair of hemispherical contact portions provided so as to sandwich the edge portion of annular conductor 140. These contact portions are locally in surface contact, which is almost in point contact, with annular conductor 140, and therefore exhibit a relatively high electrical resistance and generate relatively high heat during energization.

Second sliding contact 131 has a pair of hemispherical contact portions provided so as to sandwich the edge portion of fixed contact 110. These contact portions are locally in surface contact, which is almost in point contact, with fixed contact 110, and therefore exhibit a relatively high electrical resistance and generate relatively high heat during energization. In addition, second sliding contact 131 is provided so as to be attachable to/detachable from each fixed contact 110.

Movable element 120 is coupled to rotation shaft 11 and pivots about rotation shaft 11 by pivotal movement of rotation shaft 11. Furthermore, movable element 120 has one end coupled to first sliding contact 130 and the other end coupled to second sliding contact 131.

In other words, when movable element 120 pivots, second sliding contact 131 is brought into contact with or separated from one of seven fixed contacts 110. Fixed contact 110 in contact with second sliding contact 131 and annular conductor 140 are electrically connected to each other through second sliding contact 131, movable element 120 and first sliding contact 130.

Each of the tap changing mechanism groups includes seven input conductors electrically connected to the fixed contact connection members, respectively, and an output conductor electrically connected to the stator connection member. Each of the input conductors is electrically connected to a tap of a transformer.

Specifically, one-end side tap changing mechanism group 100*a* includes seven input conductors 108*a* electrically connected to fixed contact connection members 111*a*, respectively, and an output conductor 109*a* electrically connected to stator connection member 151*a*.

The other-end side tap changing mechanism group 100*b* includes seven input conductors 108*b* electrically connected to fixed contact connection members 111*b*, respectively, and an output conductor 109*b* electrically connected to stator connection member 151*b*.

A center line 2*a* of one-end side tap changing mechanism group 100*a* perpendicular to shaft direction 1 of rotation shaft 11 is located on second tap changing mechanism unit 102. A center line 2*b* of the other-end side tap changing mechanism group 100*b* perpendicular to shaft direction 1 of rotation shaft 11 is located on fifth tap changing mechanism unit 105.

A center line 3 of entire two tap changing mechanism groups perpendicular to shaft direction 1 of rotation shaft 11 is separated by an interval L2 from each of one-end side tap changing mechanism group 100*a* and the other-end side tap changing mechanism group 100*b*.

In one-end side tap changing mechanism group 100*a*, input connection points 118*a* between seven fixed contact connection members 111*a* and seven input conductors 108*a*, respectively, are located closer in shaft direction 1 of rotation shaft 11 to center line 3 of entire two tap changing mechanism groups than center line 2*a* of one-end side tap changing mechanism group 100*a*. Also, in one-end side tap changing mechanism group 100*a*, an output connection point 119*a* between stator connection member 151*a* and output conductor 109*a* is located closer in shaft direction 1 of rotation shaft 11 to center line 3 of entire two tap changing mechanism groups than center line 2*a* of one-end side tap changing mechanism group 100*a*.

In the other-end side tap changing mechanism group 100*b*, input connection points 118*b* between seven fixed contact connection members 111*b* and seven input conductors 108*b*, respectively, are located closer in shaft direction 1 of rotation shaft 11 to center line 3 of entire two tap changing mechanism groups than center line 2*b* of the other-end side tap changing mechanism group 100*b*. Also, in the other-end side tap changing mechanism group 100*b*, an output connection point 119*b* between stator connection member 151*b* and output conductor 109*b* is located closer in shaft direction 1 of rotation shaft 11 to center line 3 of entire two tap changing mechanism groups than center line 2*b* of the other-end side tap changing mechanism group 100*b*.

In the present embodiment, each input conductor 108*a* extends from input connection point 118*a* in the direction orthogonal to shaft direction 1 of rotation shaft 11 while output conductor 119*a* extends from output connection point 119*a* in the direction orthogonal to shaft direction 1 of rotation shaft 11.

Each input conductor 108*b* extends from input connection point 118*b* in the direction orthogonal to shaft direction 1 of rotation shaft 11 while output conductor 119*b* extends from output connection point 119*b* in the direction orthogonal to shaft direction 1 of rotation shaft 11.

For the purpose of explaining the action and effect of tap changer 10 according to the present embodiment having the above-described configuration, the tap changer according to a comparative example will be hereinafter described.

Figure 3:
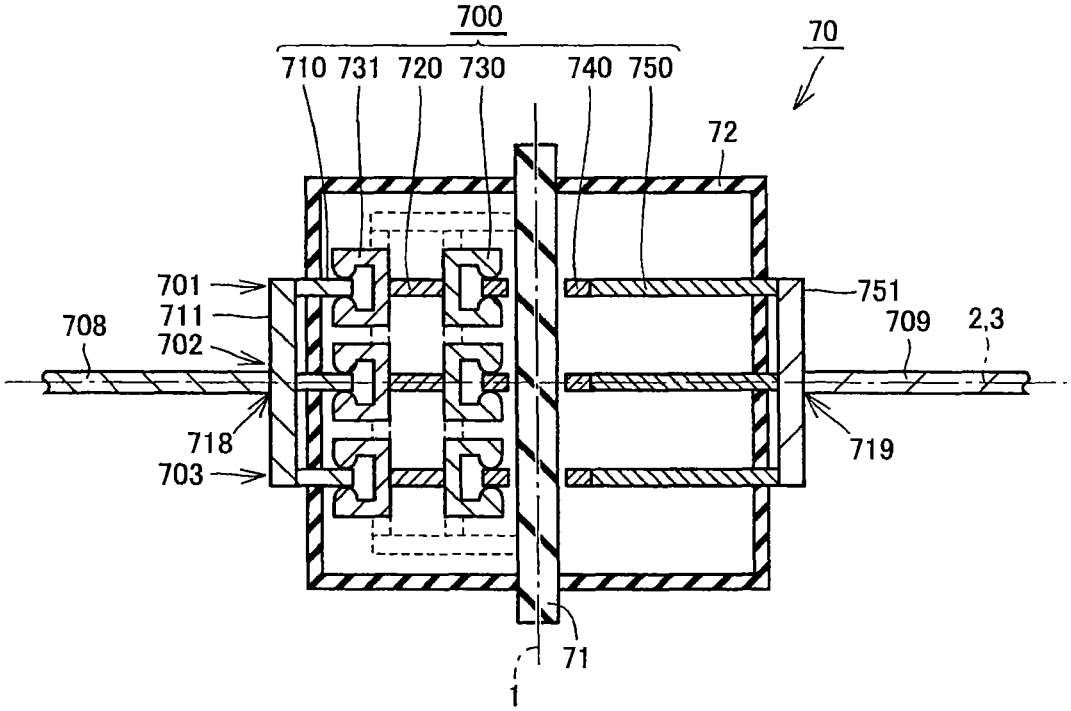
FIG. 3 is a cross-sectional view showing the configuration of a tap changer according to the first comparative example.

FIG. 3 is a cross-sectional view showing the configuration of a tap changer according to the first comparative example. As shown in FIG. 3, a tap changer 70 according to the first comparative example includes a rotation shaft 71 made of a material having electrical insulation properties, and an insulation tube 72 arranged coaxially with rotation shaft 71 and made of a material having electrical insulation properties. Rotation shaft 71 is connected to the driving source (not shown) and capable of pivoting about its shaft.

Tap changer 70 according to the first comparative example includes one tap changing mechanism group having three tap changing mechanism units 700 that are arranged at predetermined intervals in shaft direction 1 of rotation shaft 71 and electrically connected in parallel.

The tap changing mechanism group includes a first tap changing mechanism unit 701, a second tap changing mechanism unit 702 and a third tap changing mechanism unit 703 that are arranged in this order at predetermined intervals, starting from the one end side of rotation shaft 71.

First tap changing mechanism unit 701, second tap changing mechanism unit 702 and third tap changing mechanism unit 703 are electrically connected in parallel to one another by a plurality of fixed contact connection members 711 and a stator connection member 751.

Each of tap changing mechanism units 700 includes an annular conductor 740 having the center through which rotation shaft 71 passes, a plurality of fixed contacts 710 located at predetermined intervals on the concentric circumference of rotation shaft 71, a stator 750 electrically connected to annular conductor 740, a first sliding contact 730 pivoting about rotation shaft 71 while being in sliding contact with annular conductor 740, a second sliding contact 731 pivoting about rotation shaft 71 to be capable of being in sliding contact with one of the plurality of fixed contacts 710, and a movable element 720 pivoting about rotation shaft 71 together with first sliding contact 730 and second sliding contact 731 to be capable of being electrically connecting annular conductor 740 and one of the plurality of fixed contacts 710.

Specifically, in tap changer 70, three annular conductors 740 are attached to rotation shaft 71 at predetermined intervals.

In the first comparative example, in each of tap changing mechanism units 700, seven fixed contacts 710 are arranged at regular intervals on the same circumference of insulation tube 72. Specifically, fixed contacts 710 are arranged 45 degrees apart on the circumference.

Fixed contact 710 of first tap changing mechanism unit 701, fixed contact 710 of second tap changing mechanism unit 702 and fixed contact 710 of third tap changing mechanism unit 703 located at the same position in the circumferential direction of insulation tube 72 as seen in shaft direction 1 of rotation shaft 71 are electrically connected by fixed contact connection member 711. Accordingly, the tap changing mechanism group includes seven fixed contact connection members 711.

Stator 750 is provided so as to extend from one end of annular conductor 740 to the outside of insulation tube 72 in the radial direction of insulation tube 72. Stator 750 extends to pass over the circumference of insulation tube 72 at which fixed contacts 710 are located.

Stator 750 of first tap changing mechanism unit 701, stator 750 of second tap changing mechanism unit 702 and stator 750 of third tap changing mechanism unit 703 are electrically connected by stator connection member 751.

First sliding contact 730 has a pair of hemispherical contact portions provided so as to sandwich the edge portion of annular conductor 740. Second sliding contact 731 has a pair of hemispherical contact portions provided so as to sandwich the edge portion of fixed contact 710. In addition, second sliding contact 731 is provided so as to be attachable to/detachable from each fixed contact 710.

Movable element 720 is coupled to rotation shaft 71 and pivots about rotation shaft 71 by pivotal movement of rotation shaft 71. Furthermore, movable element 720 has one end coupled to first sliding contact 730 and the other end coupled to second sliding contact 731.

In other words, when movable element 720 pivots, second sliding contact 731 is brought into contact with or separated from one of seven fixed contacts 710. Fixed contact 710 in contact with second sliding contact 731 and annular conductor 740 are electrically connected to each other through second sliding contact 731, movable element 720 and first sliding contact 730.

The tap changing mechanism group includes seven input conductors 708 electrically connected to fixed contact connection members 711, respectively, and an output conductor 709 electrically connected to stator connection member 751.

Center line 2 of the tap changing mechanism group perpendicular to shaft direction 1 of rotation shaft 71 is located on second tap changing mechanism unit 702. Center line 3 of entire the tap changing mechanism groups perpendicular to shaft direction 1 of rotation shaft 71 is also located on second tap changing mechanism unit 702.

In other words, input connection points 718 between seven fixed contact connection members 711 and seven input conductors 708, respectively, in the tap changing mechanism group are located on center line 2 of the tap changing mechanism group and on center line 3 of entire the tap changing mechanism groups that are perpendicular to shaft direction 1 of rotation shaft 71. Also, an output connection point 719 between stator connection member 751 and output conductor 709 in the tap changing mechanism group is located on center line 2 of the tap changing mechanism group and on center line 3 of entire the tap changing mechanism groups that are perpendicular to shaft direction 1 of rotation shaft 71.

In tap changer 70 according to the first comparative example, in order to suppress heat generation at the contact portions of first sliding contact 730 and second sliding contact 731, first to third tap changing mechanism units 701 to 703 are connected in parallel, thereby distributing the current flowing through each tap changing mechanism unit 700. However, only three tap changing mechanism units 700 may be insufficient to cause conduction of a large current. In this case, it may be conceivable to juxtapose two tap changers 70.

Figure 4:
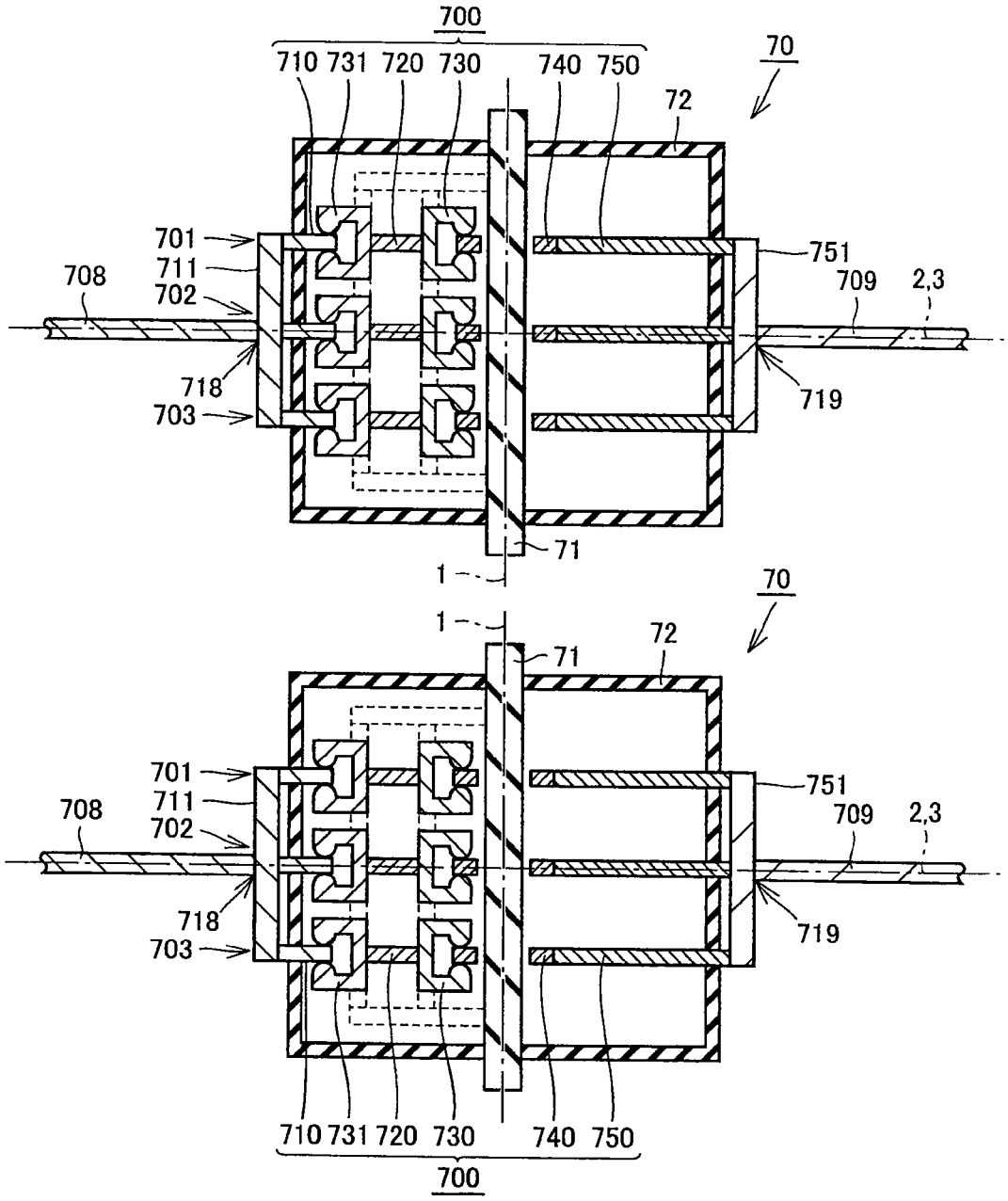
FIG. 4 is a cross-sectional view showing the state where two tap changers are juxtaposed in the second comparative example.

FIG. 4 is a cross-sectional view showing the state where two tap changers are juxtaposed in the second comparative example. As shown in FIG. 4, in the second comparative example, two juxtaposed tap changers 70 are used, thereby reducing the value of the current flowing through tap changer 70 into half.

When two tap changers 70 are juxtaposed as in the second comparative example, the area occupied by these tap changers is relatively large, which is not preferable. Thus, it is conceivable to integrate two tap changers 70 into a single unit.

Figure 5:
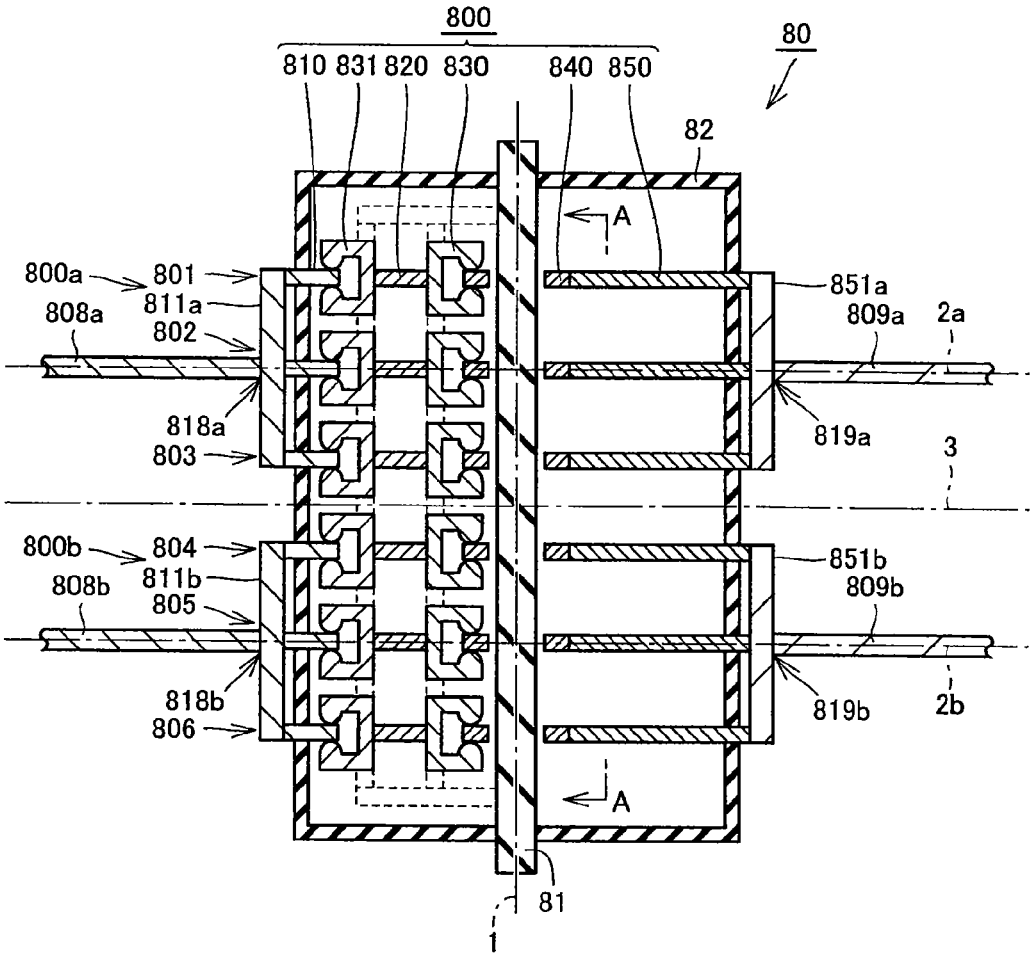
FIG. 5 is a cross-sectional view showing the configuration of a tap changer according to the third comparative example.

FIG. 5 is a cross-sectional view showing the configuration of a tap changer according to the third comparative example. As shown in FIG. 5, a tap changer 80 according to the third comparative example includes two tap changing mechanism groups.

Tap changer 80 according to the third comparative example includes a rotation shaft 81 made of a material having electrical insulation properties, and an insulation tube 82 arranged coaxially with rotation shaft 81 and made of a material having electrical insulation properties. Rotation shaft 81 is connected to the driving source (not shown) and capable of pivoting about its shaft.

Tap changer 80 includes two tap changing mechanism groups each having three tap changing mechanism units 800 that are arranged at predetermined intervals in shaft direction 1 of rotation shaft 81 and electrically connected in parallel.

Specifically, tap changer 80 includes a one-end side tap changing mechanism group 800*a* located on one end side of rotation shaft 81, and the other-end side tap changing mechanism group 800*b* located on the other end side of rotation shaft 81.

One-end side tap changing mechanism group 800*a* includes a first tap changing mechanism unit 801, a second tap changing mechanism unit 802 and a third tap changing mechanism unit 803 that are arranged in this order at predetermined intervals, starting from the one end side of rotation shaft 81 towards the middle thereof.

First tap changing mechanism unit 801, second tap changing mechanism unit 802 and third tap changing mechanism unit 803 are electrically connected in parallel to one another by a plurality of fixed contact connection members 811 and a stator connection member 851*a*.

The other-end side tap changing mechanism group 800*b* includes a fourth tap changing mechanism unit 804, a fifth tap changing mechanism unit 805 and a sixth tap changing mechanism unit 806 that are arranged at predetermined intervals in this order, starting from near the middle of rotation shaft 81 toward the other end thereof.

Fourth tap changing mechanism unit 804, fifth tap changing mechanism unit 805 and sixth tap changing mechanism unit 806 are electrically connected in parallel to one another by a plurality of fixed contact connection members 811*b* and a stator connection member 851*b*.

Each of tap changing mechanism units 800 includes an annular conductor 840 having the center through which rotation shaft 81 passes, a plurality of fixed contacts 810 located at predetermined intervals on the concentric circumference of rotation shaft 81, a stator 850 electrically connected to annular conductor 840, a first sliding contact 830 pivoting about rotation shaft 81 while being in sliding contact with annular conductor 840, a second sliding contact 831 pivoting about rotation shaft 81 to be capable of being in sliding contact with one of the plurality of fixed contacts 810, and a movable element 820 pivoting about rotation shaft 81 together with first sliding contact 830 and second sliding contact 831 to be capable of being electrically connecting annular conductor 840 and one of the plurality of fixed contacts 810.

Specifically, in tap changer 80, six annular conductors 840 are attached to rotation shaft 81 at predetermined intervals. In order to prevent each annular conductor 840 from pivoting due to pivotal movement of rotation shaft 81, each annular conductor 840 is placed on a retaining ring attached to rotation shaft 81 and fixed so as to be in sliding contact with this retaining ring.

In each of tap changing mechanism units 800, seven fixed contacts 810 are arranged at regular intervals on the same circumference of insulation tube 82. Specifically, fixed contacts 810 are arranged 45 degrees apart on the circumference.

Fixed contact 810 of first tap changing mechanism unit 801, fixed contact 810 of second tap changing mechanism unit 802 and fixed contact 810 of third tap changing mechanism unit 803 that are located at the same position in the circumferential direction of insulation tube 82 as seen in shaft direction 1 of rotation shaft 81 are electrically connected by fixed contact connection member 811*a*. Accordingly, one-end side tap changing mechanism group 800*a* includes seven fixed contact connection members 811*a*.

Fixed contact 810 of fourth tap changing mechanism unit 804, fixed contact 810 of fifth tap changing mechanism unit 805 and fixed contact 810 of sixth tap changing mechanism unit 806 that are located at the same position in the circumferential direction of insulation tube 82 as seen in shaft direction 1 of rotation shaft 81 are electrically connected by fixed contact connection member 811*b*. Accordingly, the other-end side tap changing mechanism group 800*b* includes seven fixed contact connection members 811*b*.

Stator 850 is provided so as to extend from one end of annular conductor 840 to the outside of insulation tube 82 in the radial direction of insulation tube 82. Stator 850 extends to pass over the circumference of insulation tube 82 at which fixed contacts 810 are located.

Stator 850 of first tap changing mechanism unit 801, stator 850 of second tap changing mechanism unit 802 and stator 850 of third tap changing mechanism unit 803 are electrically connected by stator connection member 851*a*.

Stator 850 of fourth tap changing mechanism unit 804, stator 850 of fifth tap changing mechanism unit 805 and stator 850 of sixth tap changing mechanism unit 806 are electrically connected by stator connection member 851*b*.

First sliding contact 830 has a pair of hemispherical contact portions provided so as to sandwich the edge portion of annular conductor 840. These contact portions are locally in surface contact, which is almost in point contact, with annular conductor 840, and therefore exhibit a relatively high electrical resistance and generate relatively high heat during energization.

Second sliding contact 831 has a pair of hemispherical contact portions provided so as to sandwich the edge portion of fixed contact 810. These contact portions are locally in surface contact, which is almost in point contact, with fixed contact 810, and therefore exhibit a relatively high electrical resistance and generate relatively high heat during energization. In addition, second sliding contact 831 is provided so as to be attachable to/detachable from each fixed contact 810.

Movable element 820 is coupled to rotation shaft 81 and pivots about rotation shaft 81 by pivotal movement of rotation shaft 81. Furthermore, movable element 820 has one end coupled to first sliding contact 830 and the other end coupled to second sliding contact 831.

In other words, when movable element 820 pivots, second sliding contact 831 is brought into contact with or separated from one of seven fixed contacts 810. Fixed contact 810 in contact with second sliding contact 831 and annular conductor 840 are electrically connected to each other through second sliding contact 831, movable element 820 and first sliding contact 830.

Each of the tap changing mechanism groups includes seven input conductors electrically connected to fixed contact connection members, respectively, and an output conductor electrically connected to stator connection member. Each input conductor is electrically connected to the tap of a transformer.

Specifically, one-end side tap changing mechanism group 800*a* includes seven input conductors 808*a* electrically connected to fixed contact connection members 811*a*, respectively, and an output conductor 809*a* electrically connected to stator connection member 851*a*.

The other-end side tap changing mechanism group 800*b* includes seven input conductors 808*b* electrically connected to fixed contact connection members 811*b*, respectively, and an output conductor 809*b* electrically connected to stator connection member 851*b*.

Center line 2*a* of one-end side tap changing mechanism group 800*a* perpendicular to shaft direction 1 of rotation shaft 81 is located on second tap changing mechanism unit 802. Center line 2*b* of the other-end side tap changing mechanism group 800*b* perpendicular to shaft direction 1 of rotation shaft 81 is located on fifth tap changing mechanism unit 805.

Center line 3 of entire two tap changing mechanism groups perpendicular to shaft direction 1 of rotation shaft 81 is equally spaced apart from one-end side tap changing mechanism group 800*a* and the other-end side tap changing mechanism group 800*b*.

In one-end side tap changing mechanism group 800*a*, input connection points 818*a* between seven fixed contact connection members 811*a* and seven input conductors 808*a*, respectively, are located on center line 2*a* of one-end side tap changing mechanism group 800*a* perpendicular to shaft direction 1 of rotation shaft 81. Also, in one-end side tap changing mechanism group 800*a*, an output connection point 819*a* between stator connection member 851*a* and output conductor 809*a* is located on center line 2*a* of one-end side tap changing mechanism group 800*a* perpendicular to shaft direction 1 of rotation shaft 81.

In the other-end side tap changing mechanism group 800*b*, input connection points 818*b* between seven fixed contact connection members 811*b* and seven input conductors 808*b*, respectively, are located on center line 2*b* of the other-end side tap changing mechanism group 800*b* perpendicular to shaft direction 1 of rotation shaft 81. Also, in the other-end side tap changing mechanism group 800*b*, an output connection point 8196 between stator connection member 851*b* and output conductor 809*b* is located on center line 2*b* of the other-end side tap changing mechanism group 800*b* perpendicular to shaft direction 1 of rotation shaft 81.

The present inventors have found that a problem occurs in tap changer 80 according to the third comparative example that a value of the current flowing through each of first tap changing mechanism unit 801 and sixth tap changing mechanism unit 806 is increased, which leads to excessive heat generation at the contact portions of these units.

Figure 6:
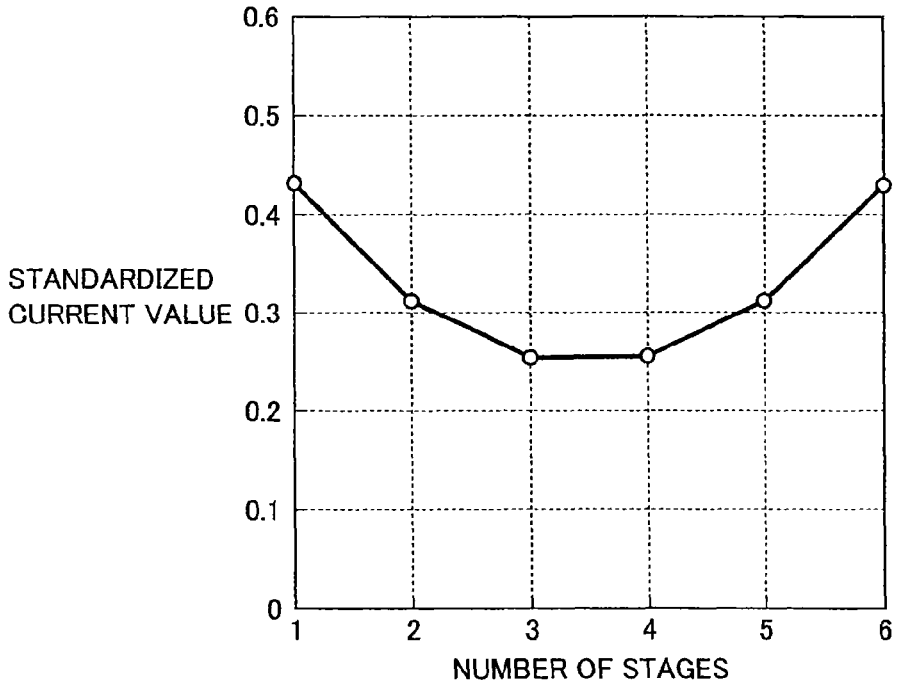
FIG. 6 is a graph showing the result of analyzing the standardized current value obtained by standardizing the amount of the current flowing through each tap changing mechanism unit in the tap changer according to the third comparative example.

FIG. 6 is a graph showing the result of analyzing the standardized current value obtained by standardizing the amount of the current flowing through each tap changing mechanism unit in the tap changer according to the third comparative example. In FIG. 6, the vertical axis shows the standardized current values and the horizontal axis shows the number of stages.

As to the number of stages, the first tap changing mechanism unit is set as the first stage, the second tap changing mechanism unit is set as the second stage, the third tap changing mechanism unit is set as the third stage, the fourth tap changing mechanism unit is set as the fourth stage, the fifth tap changing mechanism unit is set as the fifth stage, and the sixth tap changing mechanism unit is set as the sixth stage. In this analysis, tap changer 80 is modeled by the finite element method to calculate a current distribution of each stage.

As shown in FIG. 6, in tap changer 80, a current flows disproportionately more in first tap changing mechanism unit 801 and sixth tap changing mechanism unit 806 than in second to fifth tap changing mechanism units 802 to 805.

The mechanism of such a disproportionate current flow will be hereinafter described.

Figure 7:
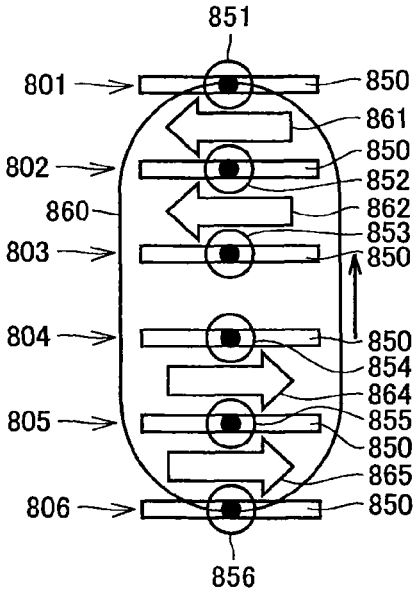
FIG. 7 is a diagram schematically showing a conducting current in each tap changing mechanism unit and a magnetic field generated by this conducting current in the tap changer according to the third comparative example.
Figure 8:
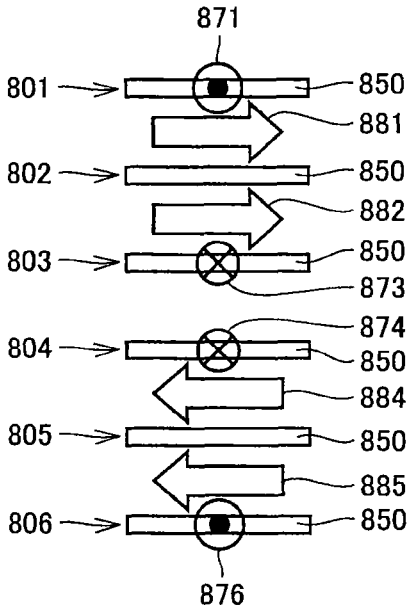
FIG. 8 is a diagram schematically showing an eddy current generated in each tap changing mechanism unit in the tap changer according to the third comparative example.
Figure 9:
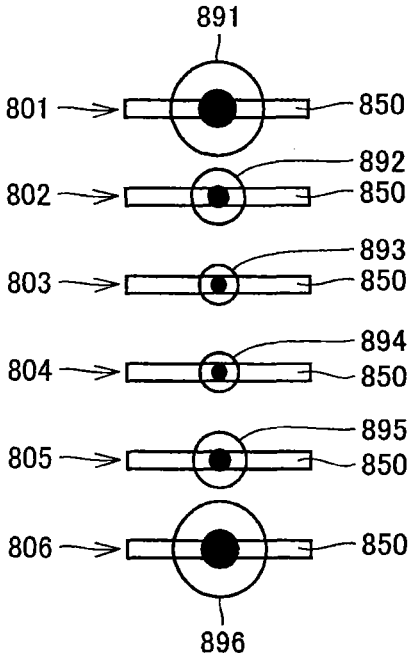
FIG. 9 is a diagram schematically showing the current flowing through each tap changing mechanism unit in the tap changer according to the third comparative example.

FIG. 7 is a diagram schematically showing a conducting current in each tap changing mechanism unit and a magnetic field generated by this conducting current in the tap changer according to the third comparative example. FIG. 8 is a diagram schematically showing an eddy current generated in each tap changing mechanism unit in the tap changer according to the third comparative example. FIG. 9 is a diagram schematically showing the current flowing through each tap changing mechanism unit in the tap changer according to the third comparative example. FIGS. 7 to 9 each show a cross-sectional view of the tap changer in FIG. 5 as seen in the direction taken along an arrow line A-A.

As shown in FIG. 7, a conducting current 851 flows through first tap changing mechanism unit 801 in the direction from the back side of the drawing sheet showing FIG. 7 to the front side of this drawing sheet. A conducting current 852 flows through second tap changing mechanism unit 802 in the direction from the back side of the drawing sheet to the front side thereof. A conducting current 853 flows through third tap changing mechanism unit 803 in the direction from the back side of the drawing sheet to the front side thereof. A conducting current 854 flows through fourth tap changing mechanism unit 804 in the direction from the back side of the drawing sheet to the front side thereof. A conducting current 855 flows through fifth tap changing mechanism unit 805 in the direction from the back side of the drawing sheet to the front side thereof. A conducting current 856 flows through sixth tap changing mechanism unit 806 in the direction from the back side of the drawing sheet to the front side thereof.

An equivalent conducting current is caused to flow through each of input conductor 808*a* and input conductor 808*b* shown in FIG. 5, so that the current values of conducting currents 851 to 856 flowing through the tap changing mechanism units become approximately the same.

Conducting currents 851 to 856 cause generation of magnetic fluxes going around tap changing mechanism units 801 to 806, respectively. These magnetic fluxes are combined together to generate a magnetic flux 860 going around in the counterclockwise direction in FIG. 7.

Magnetic flux 860 flows between first tap changing mechanism unit 801 and second tap changing mechanism unit 802 in the direction indicated by an arrow 861. Magnetic flux 860 flows between second tap changing mechanism unit 802 and third tap changing mechanism unit 803 in the direction indicated by an arrow 862.

Furthermore, magnetic flux 860 flows between fourth tap changing mechanism unit 804 and fifth tap changing mechanism unit 805 in the direction indicated by an arrow 864. Magnetic flux 860 flows between fifth tap changing mechanism unit 805 and sixth tap changing mechanism unit 806 in the direction indicated by an arrow 865.

In this way, a part of magnetic flux 860 goes around so as to cross the loop formed of first tap changing mechanism unit 801, second tap changing mechanism unit 802, fixed contact connection member 811*a*, and stator connection member 851*a*.

A part of magnetic flux 860 goes around so as to cross the loop formed of second tap changing mechanism unit 802, third tap changing mechanism unit 803, fixed contact connection member 811*a*, and stator connection member 851*a*.

Similarly, a part of magnetic flux 860 goes around so as to cross the loop formed of fourth tap changing mechanism unit 804, fifth tap changing mechanism unit 805, fixed contact connection member 811*b*, and stator connection member 851*b*.

A part of magnetic flux 860 goes around so as to cross the loop formed of fifth tap changing mechanism unit 805, sixth tap changing mechanism unit 806, fixed contact connection member 811*b*, and stator connection member 851*b*.

Magnetic flux 860 passing through the above-mentioned loop generates an eddy current that causes generation of a magnetic flux in the direction in which magnetic flux 860 is cancelled out.

Specifically, as shown in FIG. 8, an eddy current 871 flowing in the direction from the back side of the drawing sheet showing FIG. 8 to the front side thereof is generated in first tap changing mechanism unit 801. An eddy current 873 flowing in the direction from the front side of the drawing sheet to the back side thereof is generated in third tap changing mechanism unit 803. An eddy current 874 flowing in the direction from the front side of the drawing sheet to the back side thereof is generated in fourth tap changing mechanism unit 804. An eddy current 876 flowing in the direction from the back side of the drawing sheet to the front side thereof is generated in sixth tap changing mechanism unit 806.

Generation of the eddy currents as described above also causes generation of a magnetic flux flowing between first tap changing mechanism unit 801 and second tap changing mechanism unit 802 in the direction indicated by an arrow 881, a magnetic flux flowing between second tap changing mechanism unit 802 and third tap changing mechanism unit 803 in the direction indicated by an arrow 882, a magnetic flux flowing between fourth tap changing mechanism unit 804 and fifth tap changing mechanism unit 805 in the direction indicated by an arrow 884, and a magnetic flux flowing between fifth tap changing mechanism unit 805 and sixth tap changing mechanism unit 806 in the direction indicated by an arrow 885.

Currents obtained by combining the above-described conducting currents 851 to 856 and eddy currents 871 to 876, respectively, flow through tap changing mechanism units 801 to 806, respectively. In first tap changing mechanism unit 801 and sixth tap changing mechanism unit 806, since conducting currents 851 and 856 flow in the same direction as eddy currents 871 and 876, respectively, conducting current 851 and eddy current 871 are combined and conducting current 856 and eddy current 876 are combined, thereby leading to increased current values in each unit. In third tap changing mechanism unit 803 and fourth tap changing mechanism unit 804, since conducting currents 853 and 854 flow in the opposite direction from eddy currents 873 and 874, counteracting effects occurs between conducting currents 853, 854 and eddy currents 873, 874, respectively, thereby leading to decreased current values in each unit.

Consequently, as shown in FIG. 9, each current value of a current 891 flowing through first tap changing mechanism unit 801 and a current 896 flowing through sixth tap changing mechanism unit 806 is greater than each current value of a current 892 flowing through second tap changing mechanism unit 802 and a current 895 flowing through fifth tap changing mechanism unit 805.

Also, each current value of a current 893 flowing through third tap changing mechanism unit 803 and a current 894 flowing through fourth tap changing mechanism unit 804 is smaller than each current value of a current 892 flowing through second tap changing mechanism unit 802 and a current 895 flowing through fifth tap changing mechanism unit 805.

Each current value of current 891 flowing through first tap changing mechanism unit 801 and current 896 flowing through sixth tap changing mechanism unit 806 is approximately twice as high as each current value of current 893 flowing through third tap changing mechanism unit 803 and current 894 flowing through fourth tap changing mechanism unit 804.

The amount of heat generation is proportional to the square of the current value. Accordingly, in tap changer 80 according to the third comparative example, the amount of heat generation at each contact portion of first tap changing mechanism unit 801 and sixth tap changing mechanism unit 806 is approximately four times as high as the amount of heat generation at each contact portion of third tap changing mechanism unit 803 and fourth tap changing mechanism unit 804.

In order to suppress such excessive heat generation at the contact portions, tap changer 10 according to the present embodiment has the above-described configuration. Particularly, input connection point 118*a* and output connection point 119*a* are located closer in shaft direction 1 of rotation shaft 11 to center line 3 of entire two tap changing mechanism groups than center line 2*a* of one-end side tap changing mechanism group 100*a*. Furthermore, input connection point 118*b* and output connection point 119*b* are located closer in shaft direction 1 of rotation shaft 11 to center line 3 of entire two tap changing mechanism groups than center line 2*b* of the other-end side tap changing mechanism group 100*b*.

Figure 10:
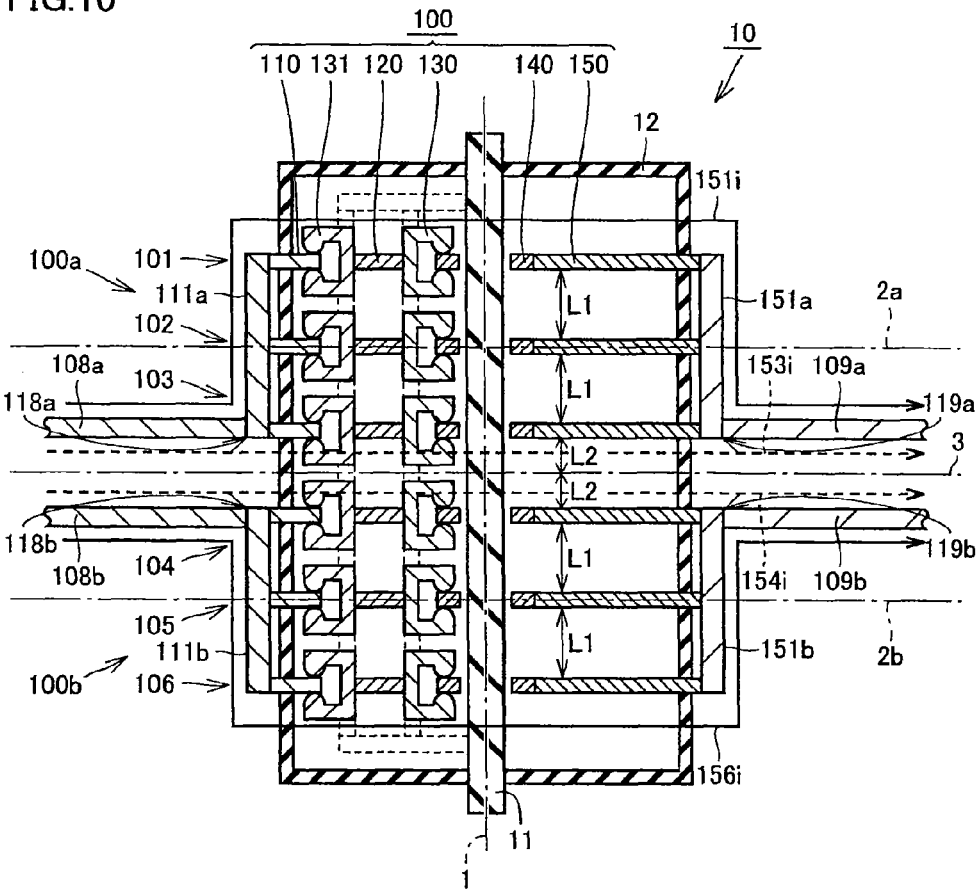
FIG. 10 is a cross-sectional view showing a part of a path of the current flowing through the tap changer according to the first embodiment.

FIG. 10 is a cross-sectional view showing a part of a path of the current flowing through the tap changer according to the present embodiment. FIG. 10 shows a current 151*i* flowing from input conductor 108*a* through first tap changing mechanism unit 101 into output conductor 109*a*; a current 153*i* flowing from input conductor 108*a* through third tap changing mechanism unit 103 into output conductor 109*a*; a current 154*i* flowing from input conductor 108*b* through fourth tap changing mechanism unit 104 into output conductor 109*b*; and a current 156*i* flowing from input conductor 108*b* through sixth tap changing mechanism unit 106 into output conductor 109*b*.

Each path through which current 151*i* and current 156*i* flow is turned and bent so as to produce a bypass, and longer than each linear path through which current 153*i* and current 154*i* flow. Accordingly, the inductance of each path through which current 151*i* and current 156*i* flow is greater than the inductance of each path through which current 153*i* and current 154*i* flow.

Therefore, the impedance of each path through which current 151*i* and current 156*i* flow with respect to an AC current is greater than the impedance of each path through which current 153*i* and current 154*i* flow. Consequently, it becomes possible to lower the value of the current flowing through each of first tap changing mechanism unit 101 and sixth tap changing mechanism unit 106.

Figure 11:
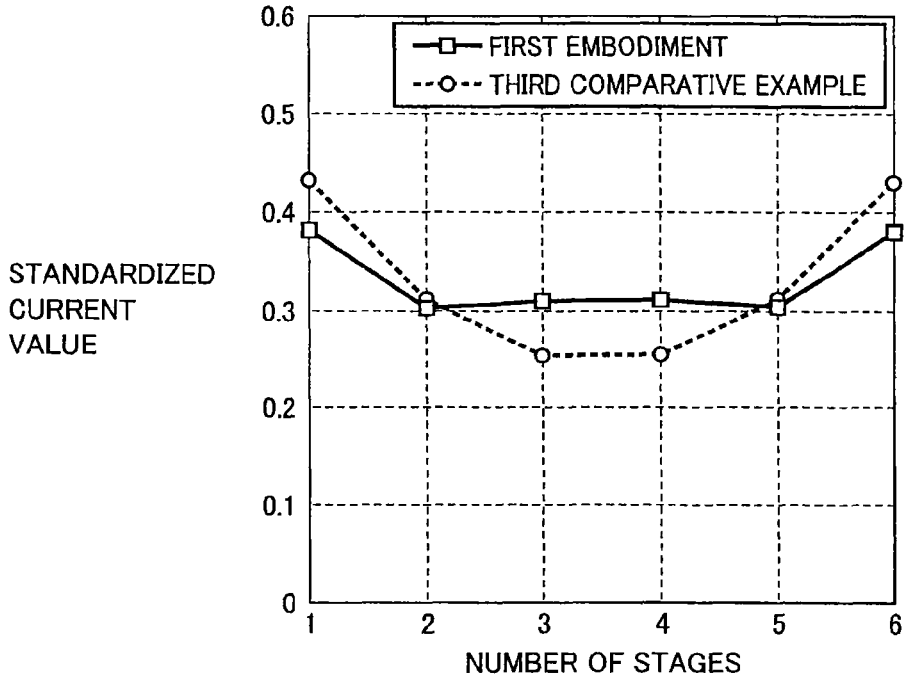
FIG. 11 is a graph showing the result of comparing standardized current values between the tap changers according to the first embodiment and the third comparative example that are obtained by standardizing the amount of current flowing through each tap changing mechanism unit.

FIG. 11 is a graph showing the result of comparing standardized current values between the tap changers according to the present embodiment and the third comparative example that are obtained by standardizing the amount of current flowing through each tap changing mechanism unit. FIG. 11 shows a result of calculation using the models of tap changer 10 according to the present embodiment and tap changer 80 according to the third comparative example that are produced based on the finite element method. Also in FIG. 11, the vertical axis shows a standardized current value, the horizontal axis shows the number of stages, the solid line shows the first embodiment, and the dotted line shows the third comparative example.

As shown in FIG. 11, in tap changer 10 according to the present embodiment, the value of each current flowing through first tap changing mechanism unit 101 and sixth tap changing mechanism unit 106 is decreased as compared with tap changer 80 according to the third comparative example, and disproportionate flow of the current is suppressed.

By suppressing disproportionate flow of the current in this way, it becomes possible to suppress occurrence of local overheating at each contact portion of first tap changing mechanism unit 101 and sixth tap changing mechanism unit 106. Consequently, local overheating occurring at the contact portions in entire tap changer 10 can be suppressed.

In the present embodiment, although input connection points 118*a*, 118*b* and output connection points 119*a*, 119*b* are arranged at positions closest to center line 3 of entire two tap changing mechanism groups perpendicular to shaft direction 1 of rotation shaft 11, arrangement of each connection point is not limited thereto.

Specifically, input connection point 118*a* and output connection point 119*a* only have to be arranged closer in shaft direction 1 of rotation shaft 11 to center line 3 of entire two tap changing mechanism groups than center line 2*a* of one-end side tap changing mechanism group 100*a*.

Similarly, input connection point 118*b* and output connection point 119*b* only have to be arranged closer in shaft direction 1 of rotation shaft 11 to center line 3 of entire two tap changing mechanism groups than center line 2*b* of the other-end side tap changing mechanism group 100*b*.

By arranging input connection points 118*a*, 118*b* and output connection points 119*a*, 119*b* in this way, disproportionate flow of the current can be suppressed to thereby allow suppression of local overheating occurring at the contact portions.

Furthermore, the number of tap changing mechanism groups included in tap changer 10 is not limited to two, but may be two or more. Furthermore, the number of tap changing mechanism units included in each tap changing mechanism group is not limited to three, but may be two or more. Also, the number of fixed contacts included in each tap changing mechanism unit is not limited to seven, but may be two or more. Therefore, fixed contacts may be arranged more than 45 degrees or arranged less than 45 degrees apart on the circumference.

Figure 12:
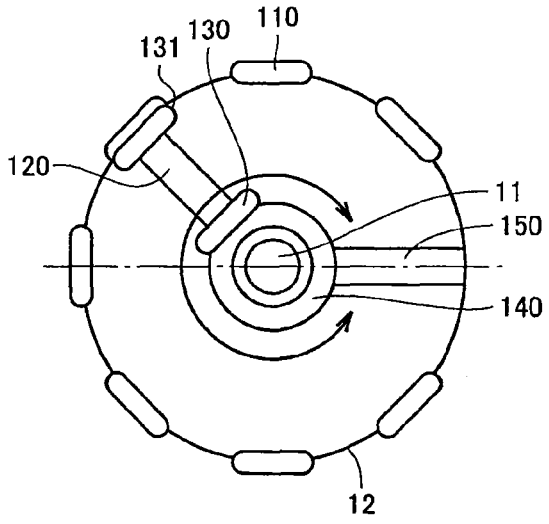
FIG. 12 is a diagram showing the state where a movable element in the state shown in FIG. 2 is moved and comes into contact with another fixed contact in the tap changer according to the first embodiment.

FIG. 12 is a diagram showing the state where a movable element in the state shown in FIG. 2 is moved and comes into contact with another fixed contact in the tap changer according to the present embodiment. As shown in FIG. 12, even in the state where movable element 120 is in contact with another fixed contact 110, disproportionate flow of the current as described above can be suppressed.

The tap changer according to the second embodiment of the present invention will be hereinafter described with reference to the drawings. Since tap changer 20 according to the present embodiment is different from tap changer 10 according to the first embodiment only in that it includes three tap changing mechanism groups each including four tap changing mechanism units, description of the same configuration as that in the first embodiment will not be repeated.

Second Embodiment

Figure 13:
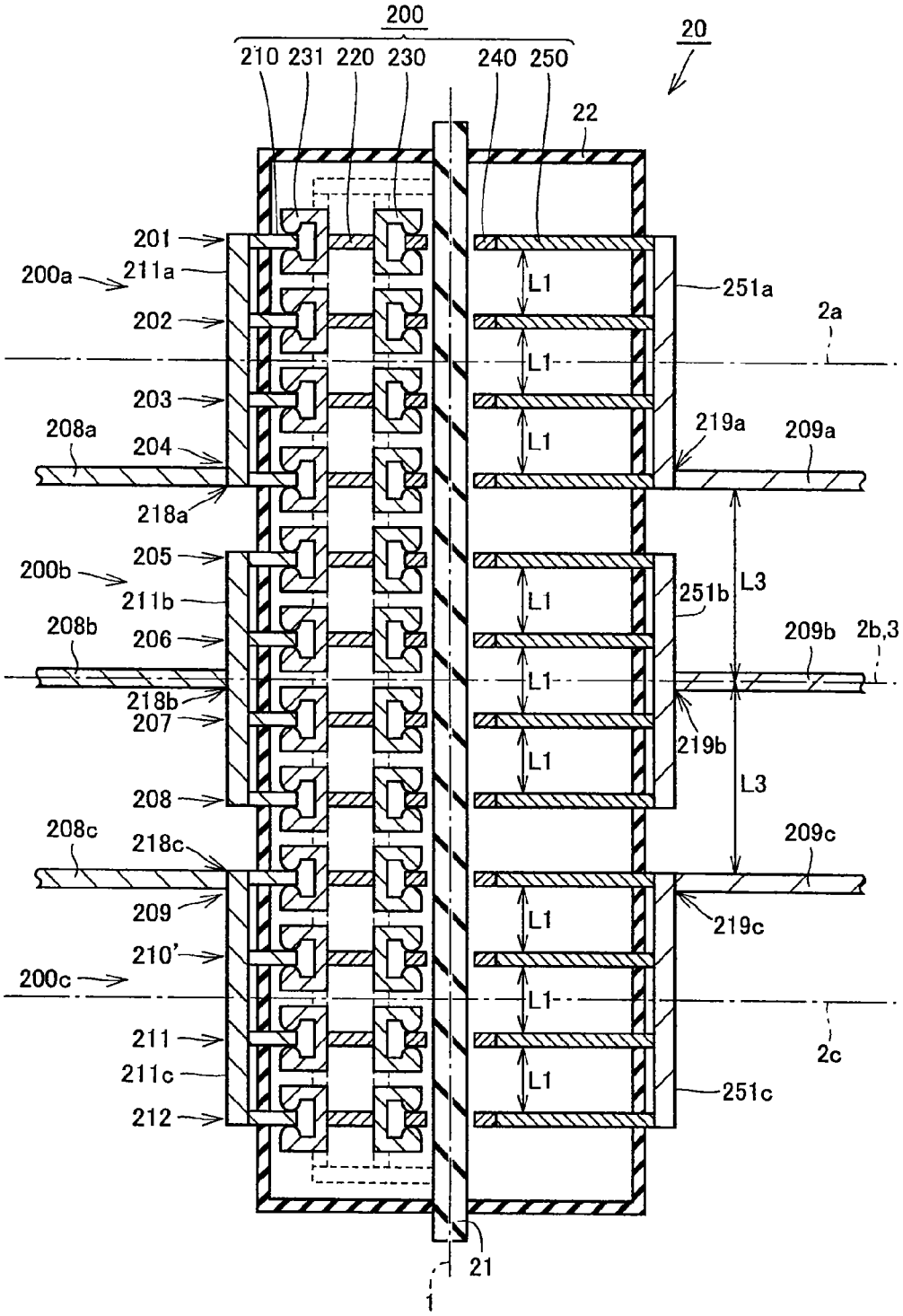
FIG. 13 is a cross-sectional view showing the configuration of a tap changer according to the second embodiment of the present invention.

FIG. 13 is a cross-sectional view showing the configuration of a tap changer according to the second embodiment of the present invention. As shown in FIG. 13, tap changer 20 according to the second embodiment of the present invention includes a rotation shaft 21 made of a material having electrical insulation properties and an insulation tube 22 arranged coaxially with rotation shaft 21 and made of a material having electrical insulation properties. Rotation shaft 21 is connected to the driving source (not shown) and capable of pivoting about its shaft. Insulation tube 22 has a diameter of about 50 cm to 100 cm, for example.

Tap changer 20 according to the present embodiment includes three tap changing mechanism groups each having four tap changing mechanism units 200 that are arranged at predetermined intervals in shaft direction 1 of rotation shaft 21 and electrically connected in parallel.

Specifically, tap changer 20 includes a one-end side tap changing mechanism group 200*a* located at the one end side of rotation shaft 21, a middle tap changing mechanism group 200*b* located at the middle of rotation shaft 21, and the other-end side tap changing mechanism group 200*c* located at the other end side of rotation shaft 21.

One-end side tap changing mechanism group 200*a* includes a first tap changing mechanism unit 201, a second tap changing mechanism unit 202, a third tap changing mechanism unit 203, and a fourth tap changing mechanism unit 204 that are arranged in this order at predetermined intervals L1, starting from the one end side of rotation shaft 21 toward the middle thereof.

First tap changing mechanism unit 201, second tap changing mechanism unit 202, third tap changing mechanism unit 203, and fourth tap changing mechanism unit 204 are electrically connected in parallel to one another by a plurality of fixed contact connection members 211*a* and a stator connection member 251*a*.

Middle tap changing mechanism group 200*b* includes a fifth tap changing mechanism unit 205, a sixth tap changing mechanism unit 206, a seventh tap changing mechanism unit 207, and an eighth tap changing mechanism unit 208 that are arranged in this order at predetermined intervals L1, starting from the one end side of rotation shaft 21 toward the other end thereof.

Fifth tap changing mechanism unit 205, sixth tap changing mechanism unit 206, seventh tap changing mechanism unit 207, and eighth tap changing mechanism unit 208 are electrically connected in parallel to one another by a plurality of fixed contact connection members 211*b* and a stator connection member 251*b*.

The other-end side tap changing mechanism group 200*c* includes a ninth tap changing mechanism unit 209, a tenth tap changing mechanism unit 210', an eleventh tap changing mechanism unit 211, and a twelfth tap changing mechanism unit 212 that are arranged in this order at predetermined intervals L1, starting from the middle of rotation shaft 21 toward the other end thereof.

Ninth tap changing mechanism unit 209, tenth tap changing mechanism unit 210', eleventh tap changing mechanism unit 211, and twelfth tap changing mechanism unit 212 are electrically connected in parallel to one another by a plurality of fixed contact connection members 211*c* and a stator connection member 251*c*.

Each of tap changing mechanism units 200 includes an annular conductor 240 having the center through which rotation shaft 21 passes, a plurality of fixed contacts 210 located at predetermined intervals on the concentric circumference of rotation shaft 21, a stator 250 electrically connected to annular conductor 240, a first sliding contact 230 pivoting about rotation shaft 21 while being in sliding contact with annular conductor 240, a second sliding contact 231 pivoting about rotation shaft 21 to be capable of being in sliding contact with one of the plurality of fixed contacts 210, and a movable element 220 pivoting about rotation shaft 21 together with first sliding contact 230 to be capable of electrically connecting annular conductor 240 and one of the plurality of fixed contacts 210.

Specifically, in tap changer 20, twelve annular conductors 240 are attached to rotation shaft 21 at predetermined intervals L1 from each other. Predetermined intervals L1 each are about 10 cm, for example. In order to prevent each annular conductor 240 from pivoting due to pivotal movement of rotation shaft 21, each annular conductor 240 is placed on a retaining ring attached to rotation shaft 21 and fixed so as to be in sliding contact with this retaining ring.

In the present embodiment, in each of tap changing mechanism units 200, seven fixed contacts 210 are arranged at regular intervals on the same circumference of insulation tube 22. Specifically, in the present embodiment, fixed contacts 210 are arranged 45 degrees apart on the circumference.

Fixed contact 210 of first tap changing mechanism unit 201, fixed contact 210 of second tap changing mechanism unit 202, fixed contact 210 of third tap changing mechanism unit 203, and fixed contact 210 of fourth tap changing mechanism unit 204 that are located at the same position in the circumferential direction of insulation tube 22 as seen in shaft direction 1 of rotation shaft 21 are electrically connected by fixed contact connection member 211*a*.

Accordingly, one-end side tap changing mechanism group 200*a* includes seven fixed contact connection members 211*a*. Each fixed contact connection member 211*a* has a length equal to that linearly connecting fixed contact 210 of first tap changing mechanism unit 201 and fixed contact 210 of fourth tap changing mechanism unit 204.

Fixed contact 210 of fifth tap changing mechanism unit 205, fixed contact 210 of sixth tap changing mechanism unit 206, fixed contact 210 of seventh tap changing mechanism unit 207, and fixed contact 210 of eighth tap changing mechanism unit 208 that are located at the same position in the circumferential direction of insulation tube 22 as seen in shaft direction 1 of rotation shaft 21 are electrically connected by fixed contact connection member 211*b*.

Accordingly, middle tap changing mechanism group 200*b* includes seven fixed contact connection members 211*b*. Each fixed contact connection member 211*b* has a length equal to that linearly connecting fixed contact 210 of fifth tap changing mechanism unit 501 and fixed contact 210 of eighth tap changing mechanism unit 208.

Fixed contact 210 of ninth tap changing mechanism unit 209, fixed contact 210 of tenth tap changing mechanism unit 210', fixed contact 210 of eleventh tap changing mechanism unit 211, and fixed contact 210 of twelfth tap changing mechanism unit 212 that are located at the same position in the circumferential direction of insulation tube 22 as seen in shaft direction 1 of rotation shaft 21 are electrically connected by fixed contact connection member 211*c*.

Accordingly, the other-end side tap changing mechanism group 200*c* includes seven fixed contact connection members 211*c*. Each fixed contact connection member 211*c* has a length equal to that linearly connecting fixed contact 210 of ninth tap changing mechanism unit 209 and fixed contact 210 of twelfth tap changing mechanism unit 212.

Stator 250 is provided so as to extend from one end of annular conductor 240 to the outside of insulation tube 22 in the radial direction of insulation tube 22. Stator 250 extends to pass over the circumference of insulation tube 22 at which fixed contacts 210 are located.

Stator 250 of first tap changing mechanism unit 201, stator 250 of second tap changing mechanism unit 202, stator 250 of third tap changing mechanism unit 203, and stator 250 of fourth tap changing mechanism unit 204 are electrically connected by stator connection member 251*a*. Stator connection member 251*a* has a length equal to that linearly connecting stator 250 of first tap changing mechanism unit 201 and stator 250 of fourth tap changing mechanism unit 204.

Stator 250 of fifth tap changing mechanism unit 205, stator 250 of sixth tap changing mechanism unit 206, stator 250 of seventh tap changing mechanism unit 207, and stator 250 of eighth tap changing mechanism unit 208 are electrically connected by stator connection member 251*b*. Stator connection member 251*b* has a length equal to that linearly connecting stator 250 of fifth tap changing mechanism unit 205 and stator 250 of eighth tap changing mechanism unit 208.

Stator 250 of ninth tap changing mechanism unit 209, stator 250 of tenth tap changing mechanism unit 210', stator 250 of eleventh tap changing mechanism unit 211, and stator 250 of twelfth tap changing mechanism unit 212 are electrically connected by stator connection member 251*c*. Stator connection member 251*c* has a length equal to that linearly connecting stator 250 of ninth tap changing mechanism unit 209 and stator 250 of twelfth tap changing mechanism unit 212.

First sliding contact 230 has a pair of hemispherical contact portions provided so as to sandwich the edge portion of annular conductor 240. These contact portions are locally in surface contact, which is almost in point contact, with annular conductor 240, and therefore exhibit a relatively high electrical resistance and generate relatively high heat during energization.

Second sliding contact 231 has a pair of hemispherical contact portions provided so as to sandwich the edge portion of fixed contact 210. These contact portions are locally in surface contact, which is almost in point contact, with fixed contact 210, and therefore exhibit a relatively high electrical resistance and generate relatively high heat during energization. In addition, second sliding contact 231 is provided so as to be attachable to/detachable from each fixed contact 210.

Movable element 220 is coupled to rotation shaft 21, and pivots about rotation shaft 21 by pivotal movement of rotation shaft 21. Furthermore, movable element 220 has one end coupled to first sliding contact 230 and the other end coupled to second sliding contact 231.

In other words, when movable element 220 pivots, second sliding contact 231 is brought into contact with or separated from one of seven fixed contacts 210. Fixed contact 210 in contact with second sliding contact 231 and annular conductor 240 are electrically connected to each other through second sliding contact 231, movable element 220 and first sliding contact 230.

Each of the tap changing mechanism groups includes seven input conductors electrically connected to fixed contact connection members, respectively, and an output conductor electrically connected to the stator connection member. Each of the input conductors is electrically connected to the tap of a transformer.

Specifically, one-end side tap changing mechanism group 200*a* includes seven input conductors 208*a* electrically connected to fixed contact connection members 211*a*, respectively, and an output conductor 209*a* electrically connected to stator connection member 251*a*.

Middle tap changing mechanism group 200*b* includes seven input conductors 208*b* electrically connected to fixed contact connection members 211*b*, respectively, and an output conductor 209*b* electrically connected to stator connection member 251*b*.

The other-end side tap changing mechanism group 200*c* includes seven input conductors 208*c* electrically connected to fixed contact connection members 211*c*, respectively, and an output conductor 209*c* electrically connected to stator connection member 251*c*.

Center line 2*a* of one-end side tap changing mechanism group 200*a* perpendicular to shaft direction 1 of rotation shaft 21 is located between second tap changing mechanism unit 202 and third tap changing mechanism unit 203. Center line 2*b* of middle tap changing mechanism group 200*b* perpendicular to shaft direction 1 of rotation shaft 21 is located between sixth tap changing mechanism unit 206 and seventh tap changing mechanism unit 207. Center line 2*c* of the other-end side tap changing mechanism group 200*c* perpendicular to shaft direction 1 of rotation shaft 21 is located between tenth tap changing mechanism unit 210' and eleventh tap changing mechanism unit 211.

Center line 3 of entire three tap changing mechanism groups perpendicular to shaft direction 1 of rotation shaft 21 is separated by an interval L3 from each of one-end side tap changing mechanism group 200*a* and the other-end side tap changing mechanism group 200*c*. Center line 2*b* of middle tap changing mechanism group 200*b* and center line 3 of entire three tap changing mechanism groups overlap with each other.

In one-end side tap changing mechanism group 200*a*, input connection points 218*a* between seven fixed contact connection members 211*a* and seven input conductors 218*a*, respectively, are located closer in shaft direction 1 of rotation shaft 21 to center line 3 of entire three tap changing mechanism groups than center line 2*a* of one-end side tap changing mechanism group 200*a*. Also in one-end side tap changing mechanism group 200*a*, an output connection point 219*a* between stator connection member 251*a* and output conductor 209*a* is located closer in shaft direction 1 of rotation shaft 21 to center line 3 of entire three tap changing mechanism groups than center line 2*a* of one-end side tap changing mechanism group 200*a*.

In the other-end side tap changing mechanism group 200*c*, input connection points 218*c* between seven fixed contact connection members 211*c* and seven input conductors 208*c*, respectively, are located closer in shaft direction 1 of rotation shaft 21 to center line 3 of entire three tap changing mechanism groups than center line 2*c* of the other-end side tap changing mechanism group 200*c*. Also, in the other-end side tap changing mechanism group 200*c*, an output connection point 219*c* between stator connection member 251*c* and output conductor 209*c* is located closer in shaft direction 1 of rotation shaft 21 to center line 3 of entire three tap changing mechanism groups than center line 2*c* of the other-end side tap changing mechanism group 200*c*.

In the present embodiment, input conductors 208*a* each extend from input connection point 218*a* in the direction orthogonal to shaft direction 1 of rotation shaft 21, while output conductor 209*a* extends from output connection point 219*a* in the direction orthogonal to shaft direction 1 of rotation shaft 21.

Input conductors 208*c* each extend from input connection point 218*c* in the direction orthogonal to shaft direction 1 of rotation shaft 21, while output conductor 209*c* extends from output connection point 219*c* in the direction orthogonal to shaft direction 1 of rotation shaft 21.

Also in tap changer 20 according to the present embodiment, in one-end side tap changing mechanism group 200*a*, the current flowing through first tap changing mechanism unit 201 is decreased to thereby allow disproportionate flow of the current to be suppressed. Furthermore, in the other-end side tap changing mechanism group 200*c*, the current flowing through twelfth tap changing mechanism unit 212 is decreased to thereby allow disproportionate flow of the current to be suppressed.

By suppressing disproportionate flow of the current in this way, it becomes possible to suppress occurrence of local overheating at the contact portions of first tap changing mechanism unit 201 and twelfth tap changing mechanism unit 212. Consequently, local overheating occurring at the contact portions can be suppressed in entire tap changer 20.

The tap changer according to the third embodiment of the present invention will be hereinafter described with reference to the drawings. Since the tap changer according to the present embodiment is different from tap changer 10 according to the first embodiment only in the shapes of the input conductor and the output conductor, description of the same configuration as that in the first embodiment will not be repeated.

Third Embodiment

Figure 14:
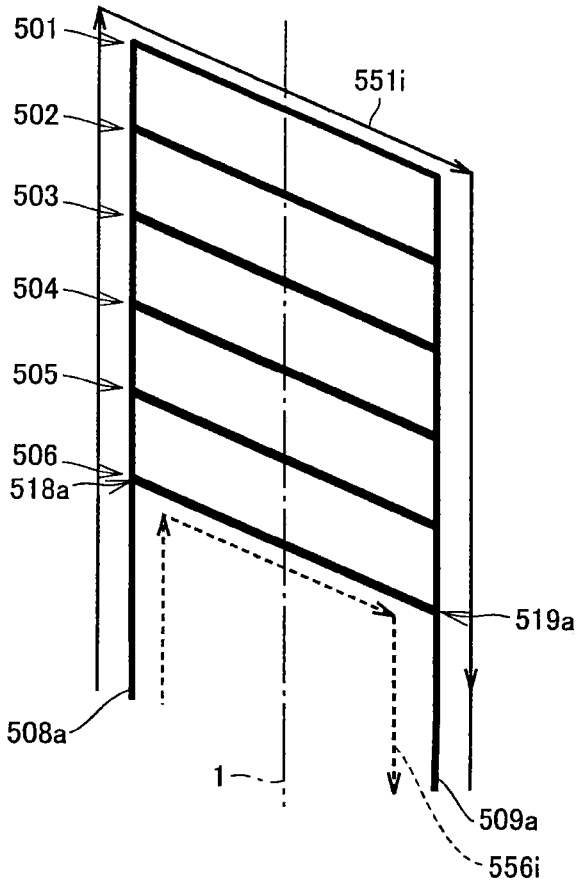
FIG. 14 is a cross-sectional view schematically showing the configuration of a tap changer according to the fourth comparative example.
Figure 15:
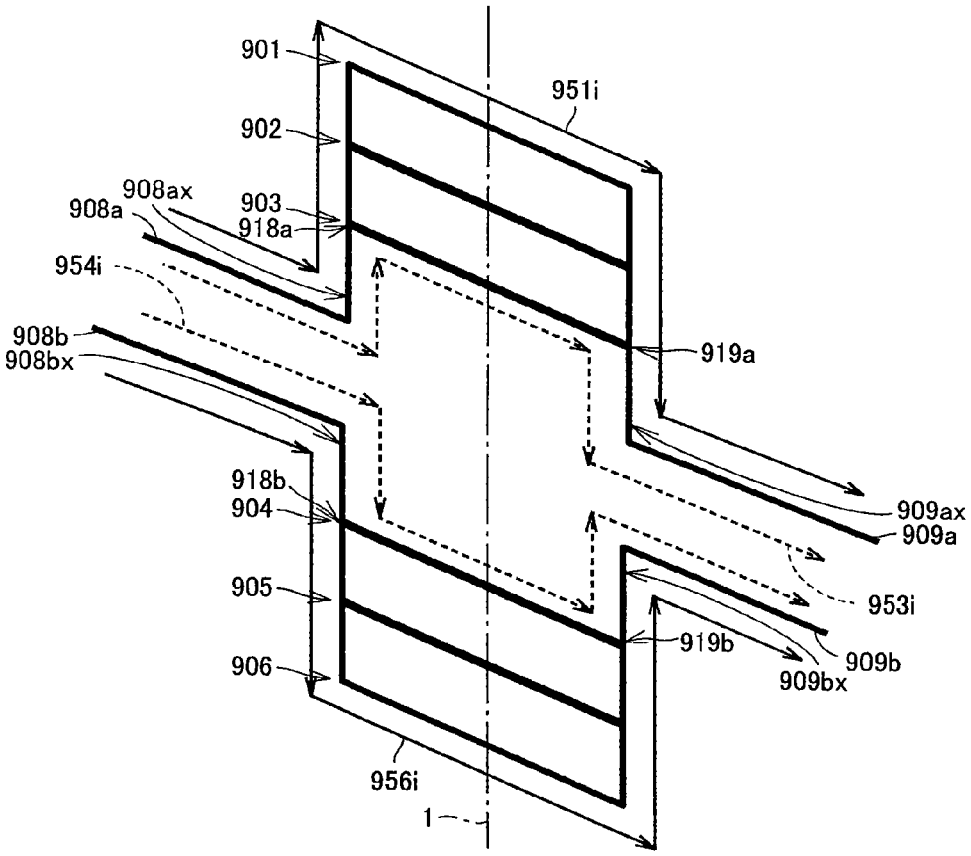
FIG. 15 is a cross-sectional view schematically showing the configuration of a tap changer according to a modification of the first embodiment of the present invention, similarly to FIG. 14.
Figure 16:
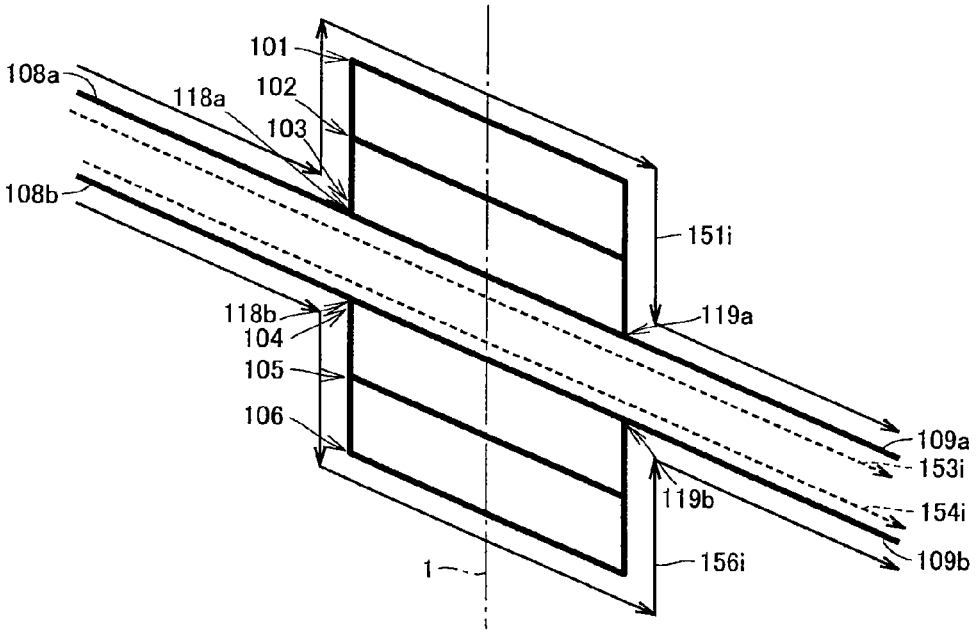
FIG. 16 is a cross-sectional view schematically showing the configuration of the tap changer according to the first embodiment of the present invention, similarly to FIG. 14.
Figure 17:
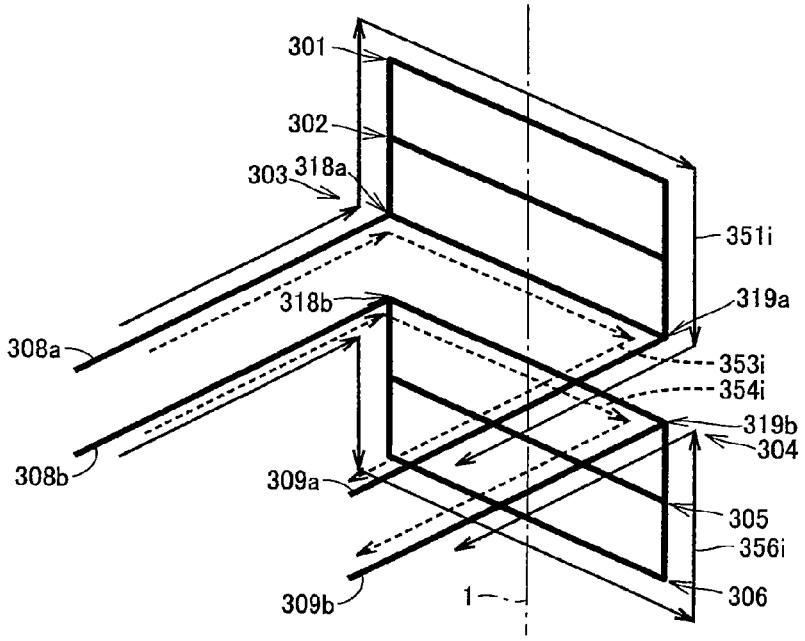
FIG. 17 is a cross-sectional view schematically showing the configuration of a tap changer according to the third embodiment of the present invention, similarly to FIG. 14.

FIG. 14 is a cross-sectional view schematically showing the configuration of a tap changer according to the fourth comparative example. FIG. 15 is a cross-sectional view schematically showing the configuration of a tap changer according to a modification of the first embodiment of the present invention, similarly to FIG. 14. FIG. 16 is a cross-sectional view schematically showing the configuration of the tap changer according to the first embodiment of the present invention, similarly to FIG. 14. FIG. 17 is a cross-sectional view schematically showing the configuration of a tap changer according to the third embodiment of the present invention, similarly to FIG. 14.

The tap changer according to the fourth comparative example will be first described. As shown in FIG. 14, the tap changer according to the fourth comparative example includes one tap changing mechanism group including first to sixth tap changing mechanism units 501 to 506.

The tap changing mechanism group includes an input conductor 508*a* and an output conductor 509*a*. Input conductor 508*a* extends from an input connection point 518*a* so as to be parallel to shaft direction 1 of the rotation shaft. Output conductor 509*a* extends from an output connection point 519*a* so as to be parallel to shaft direction 1 of the rotation shaft.

FIG. 14 shows a current 551*i* flowing from input conductor 508*a* through first tap changing mechanism unit 501 into output conductor 509*a*, and a current 556*i* flowing from input conductor 508*a* through third tap changing mechanism unit 506 into output conductor 509*a*. As described above, by combination of the conducting current and the eddy current, the value of each of current 551*i* and current 556*i* is greater than the value of each current flowing through other paths.

In the tap changer according to the fourth comparative example, the path through which current 551*i* flows is longer than the path through which current 556*i* flows. Accordingly, the inductance and the impedance each are greater in the path through which current 551*i* flows than in the path through which current 556*i* flows. Since the value of current 556*i* becomes extremely high due to the above-described differences of the inductance and the impedance, the tap changer according to the fourth comparative example is not preferable.

The tap changer according to a modification of the first embodiment of the present invention will then be described. As shown in FIG. 15, the tap changer according to the modification of the first embodiment of the present invention includes a one-end side tap changing mechanism group having first to third tap changing mechanism units 901 to 903, and the other-end side tap changing mechanism group having fourth to sixth tap changing mechanism units 904 to 906.

The one-end side tap changing mechanism group includes an input conductor 908*a* and an output conductor 909*a*. Input conductor 908*a* extends from an input connection point 918*a* so as to be parallel to shaft direction 1 of the rotation shaft, and then, extends in the direction orthogonal to shaft direction 1 of the rotation shaft. In other words, input conductor 908*a* includes a bypass portion 908*ax* extending parallel to shaft direction 1 of the rotation shaft.

Output conductor 909*a* extends from an output connection point 919*a* so as to be parallel to shaft direction 1 of the rotation shaft, and then, extends in the direction orthogonal to shaft direction 1 of the rotation shaft. In other words, output conductor 909*a* includes a bypass portion 909*ax* extending parallel to shaft direction 1 of the rotation shaft.

The other-end side tap changing mechanism group includes an input conductor 908*b* and an output conductor 909*b*. Input conductor 908*b* extends from an input connection point 918*b* so as to be parallel to shaft direction 1 of the rotation shaft, and then, extends in the direction orthogonal to shaft direction 1 of the rotation shaft. In other words, input conductor 908*b* includes a bypass portion 908*bx* extending parallel to shaft direction 1 of the rotation shaft.

Output conductor 909*b* extends from an output connection point 919*b* so as to be parallel to shaft direction 1 of the rotation shaft, and then, extends in the direction orthogonal to shaft direction 1 of the rotation shaft. In other words, output conductor 909*b* includes a bypass portion 909*bx* extending parallel to shaft direction 1 of the rotation shaft.

FIG. 15 shows a current 951*i* flowing from input conductor 908*a* through first tap changing mechanism unit 901 into output conductor 909*a*, a current 953*i* flowing from input conductor 908*a* through third tap changing mechanism unit 903 into output conductor 909*a*, a current 954*i* flowing from input conductor 908*b* through fourth tap changing mechanism unit 904 into output conductor 909*b*, and a current 956*i* flowing from input conductor 908*b* through sixth tap changing mechanism unit 906 into output conductor 909*b*.

In the tap changer according to the modification of the first embodiment of the present invention, each path through which current 953*i* and current 954*i* flow is also turned and bent so as to produce a bypass. Thus, the difference in length between each path of current 953*i* and current 954*i* and each path of current 951*i* and current 956*i* is relatively small as compared with the tap changer according to the first embodiment shown in FIG. 16.

Accordingly, in the tap changer according to the modification of the first embodiment of the present invention, the effect of reducing each current flowing through first and sixth tap changing mechanism units 901 and 906 to suppress disproportionate flow of the current is smaller than that of tap changer 10 according to the first embodiment.

Therefore, it is preferable that the input conductor extends from the input connection point in the direction orthogonal to the shaft direction of the rotation shaft while the output conductor extends from the output connection point in the direction orthogonal to the shaft direction of the rotation shaft.

As shown in FIG. 17, the tap changer according to the third embodiment of the present invention includes a one-end side tap changing mechanism group including first to third tap changing mechanism units 301 to 303, and the other-end side tap changing mechanism group including fourth to sixth tap changing mechanism units 304 to 306.

One-end side tap changing mechanism group includes an input conductor 308*a* and an output conductor 309*a*. Input conductor 308*a* extends from an input connection point 318*a* in the direction orthogonal to shaft direction 1 of the rotation shaft. Output conductor 309*a* extends from an output connection point 319*a* in the direction orthogonal to shaft direction 1 of the rotation shaft. Output conductor 309*a* is located parallel to input conductor 308*a*.

The other-end side tap changing mechanism group includes an input conductor 308*b* and an output conductor 309*b*. Input conductor 308*b* extends from an input connection point 318*b* in the direction orthogonal to shaft direction 1 of the rotation shaft. Output conductor 309*b* extends from an output connection point 319*b* in the direction orthogonal to shaft direction 1 of the rotation shaft. Output conductor 309*b* is located parallel to input conductor 308*b*.

FIG. 17 shows a current 351*i* flowing from input conductor 308*a* through first tap changing mechanism unit 301 into output conductor 309*a*, a current 353*i* flowing from input conductor 308*a* through third tap changing mechanism unit 303 into output conductor 309*a*, a current 354*i* flowing from input conductor 308*a* through fourth tap changing mechanism unit 304 into output conductor 309*b*, and a current 356*i* flowing from input conductor 308*b* through sixth tap changing mechanism unit 306 into output conductor 309*b*.

Each path through which current 351*i* and current 356*i* flow is turned and bent so as to produce a bypass, and longer than each path through which current 353*i* and current 354*i* flow. Accordingly, the inductance of each path through which current 351*i* and current 356*i* flow is greater than the inductance of each path through which current 353*i* and current 354*i* flow.

Accordingly, the impedance of each path through which current 351*i* and current 356*i* flow with respect to an AC current is greater than the impedance of each path through which current 353*i* and current 354*i* flow. Consequently, it becomes possible to decrease the value of the current flowing through each of first tap changing mechanism unit 301 and sixth tap changing mechanism unit 306.

In the tap changer according to the present embodiment, as compared with the tap changers according to the third comparative example and the modification of the first embodiment of the present invention, the value of each current flowing through first tap changing mechanism unit 301 and sixth tap changing mechanism unit 306 is decreased, thereby suppressing disproportionate flow of the current.

By suppressing disproportionate flow of the current in this way, it becomes possible to suppress local overheating occurring at contact portions of first tap changing mechanism unit 301 and sixth tap changing mechanism unit 306. Consequently, local overheating occurring at the contact portions can be suppressed in entire the tap changer.

Furthermore, by arranging input conductors 308*a* and 308*b* and output conductors 309*a* and 309*b* in parallel, the area occupied by the tap changer can be reduced to allow size reduction.

The tap changer according to the fourth embodiment of the present invention will be hereinafter described with reference to the drawings. Since the tap changer according to the present embodiment is different from tap changer 10 according to the first embodiment only in the distance between the tap changing mechanism units, description of the same configuration as that of the first embodiment will not be repeated.

Fourth Embodiment

Figure 18:
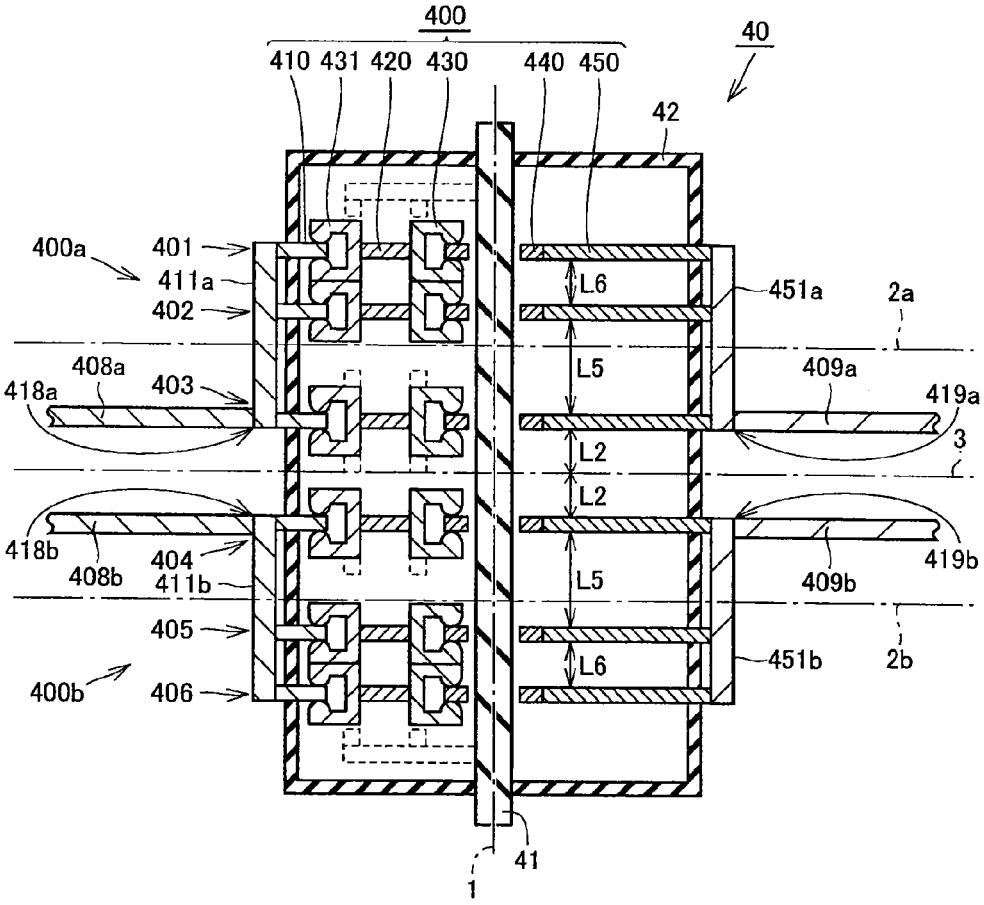
FIG. 18 is a cross-sectional view showing the configuration of a tap changer according to the fourth embodiment of the present invention.

FIG. 18 is a cross-sectional view showing the configuration of a tap changer according to the fourth embodiment of the present invention. As shown in FIG. 18, a tap changer 40 according to the fourth embodiment of the present invention includes a rotation shaft 41 made of a material having electrical insulation properties, and an insulation tube 42 arranged coaxially with rotation shaft 41 and made of a material having electrical insulation properties. Rotation shaft 41 is connected to the driving source (not shown) and capable of pivoting about its shaft. Insulation tube 42 has a diameter of about 50 cm to 100 cm, for example.

Tap changer 40 according to the present embodiment includes two tap changing mechanism groups each having three tap changing mechanism units 400 that are arranged at predetermined intervals in shaft direction 1 of rotation shaft 41 and electrically connected in parallel.

Furthermore, distances between adjacent tap changing mechanism units 400 in shaft direction 1 of rotation shaft 41 are different. Furthermore, in the end-side tap changing mechanism group, the distance between adjacent tap changing mechanism units 400 located on the endmost side in shaft direction 1 of rotation shaft 41 is smaller than each distance between other adjacent tap changing mechanism units 400.

Specifically, tap changer 40 includes a one-end side tap changing mechanism group 400*a* located on the one end side of rotation shaft 41 and the other-end side tap changing mechanism group 400*b* located on the other end side of rotation shaft 41.

One-end side tap changing mechanism group 400*a* includes a first tap changing mechanism unit 401, a second tap changing mechanism unit 402 and a third tap changing mechanism unit 403 that are arranged in this order at predetermined intervals, starting from the one end side of rotation shaft 41 toward the middle thereof.

There is an interval L6 between first tap changing mechanism unit 401 and second tap changing mechanism unit 402. There is an interval L5 between second tap changing mechanism unit 402 and third tap changing mechanism unit 403. Interval L5 is greater than interval L6. Also, interval L6 is smaller than interval L1 in tap changer 10 according to the first embodiment.

First tap changing mechanism unit 401, second tap changing mechanism unit 402 and third tap changing mechanism unit 403 are electrically connected in parallel by a plurality of fixed contact connection members 411*a* and a stator connection member 451*a*.

The other-end side tap changing mechanism group 400*b* includes a fourth tap changing mechanism unit 404, a fifth tap changing mechanism unit 405 and a sixth tap changing mechanism unit 406 that are arranged in this order at predetermined intervals, starting from near the middle of rotation shaft 41 toward the other end thereof.

There is interval L5 between fourth tap changing mechanism unit 404 and fifth tap changing mechanism unit 405. There is interval L6 between fifth tap changing mechanism unit 405 and sixth tap changing mechanism unit 406. Interval L5 is greater than interval L6. Also, interval L6 is smaller than interval L1 in tap changer 10 according to the first embodiment.

Fourth tap changing mechanism unit 404, fifth tap changing mechanism unit 405 and sixth tap changing mechanism unit 406 are electrically connected in parallel by a plurality of fixed contact connection members 411*b* and a stator connection member 451*b*.

Each of tap changing mechanism units 400 includes an annular conductor 440 having the center through which rotation shaft 41 passes, a plurality of fixed contacts 410 located at predetermined intervals on the concentric circumference of rotation shaft 41, a stator 450 electrically connected to annular conductor 440, a first sliding contact 430 pivoting about rotation shaft 41 while being in sliding contact with annular conductor 440, a second sliding contact 431 pivoting about rotation shaft 41 to be capable of being in sliding contact with one of the plurality of fixed contacts 410, and a movable element 420 pivoting about rotation shaft 41 together with first sliding contact 430 and second sliding contact 431 to be capable of electrically connecting annular conductor 440 and one of the plurality of fixed contacts 410.

Specifically, in tap changer 40, six annular conductors 440 are attached to rotation shaft 41 at predetermined intervals. In order to prevent each annular conductor 440 from pivoting due to pivotal movement of rotation shaft 41, each annular conductor 440 is placed on a retaining ring attached to rotation shaft 41 and fixed so as to be in sliding contact with this retaining ring.

In the present embodiment, in each of tap changing mechanism units 400, seven fixed contacts 410 are arranged at regular intervals on the same circumference of insulation tube 42. Specifically, in the present embodiment, fixed contacts 410 are arranged 45 degrees apart on the circumference.

Fixed contact 410 of first tap changing mechanism unit 401, fixed contact 410 of second tap changing mechanism unit 402 and fixed contact 410 of third tap changing mechanism unit 403 that are located at the same position in the circumferential direction of insulation tube 42 as seen in shaft direction 1 of rotation shaft 41 are electrically connected by fixed contact connection member 411*a*.

Accordingly, one-end side tap changing mechanism group 400*a* includes seven fixed contact connection members 411*a*. Fixed contact connection members 411*a* each have a length equal to that linearly connecting fixed contact 410 of first tap changing mechanism unit 401 and fixed contact 410 of third tap changing mechanism unit 403.

Fixed contact 410 of fourth tap changing mechanism unit 404, fixed contact 410 of fifth tap changing mechanism unit 405 and fixed contact 410 of sixth tap changing mechanism unit 406 that are located at the same position in the circumferential direction of insulation tube 42 as seen in shaft direction 1 of rotation shaft 41 are electrically connected by fixed contact connection member 411*b*.

Accordingly, the other-end side tap changing mechanism group 400*b* includes seven fixed contact connection members 411*b*. Fixed contact connection members 411*b* each have a length equal to that linearly connecting fixed contact 410 of fourth tap changing mechanism unit 404 and fixed contact 410 of sixth tap changing mechanism unit 406.

Stator 450 is provided so as to extend from one end of annular conductor 440 to the outside of insulation tube 42 in the radial direction of insulation tube 42. Stator 450 extends to pass over the circumference of insulation tube 42 at which fixed contacts 410 are located.

Stator 450 of first tap changing mechanism unit 401, stator 450 of second tap changing mechanism unit 402 and stator 450 of third tap changing mechanism unit 403 are electrically connected by stator connection member 451*a*. Stator connection member 451*a* has a length equal to that linearly connecting stator 450 of first tap changing mechanism unit 401 and stator 450 of third tap changing mechanism unit 403.

Stator 450 of fourth tap changing mechanism unit 404, stator 450 of fifth tap changing mechanism unit 405 and stator 450 of sixth tap changing mechanism unit 406 are electrically connected by stator connection member 451*b*. Stator connection member 451*b* has a length equal to that linearly connecting stator 450 of fourth tap changing mechanism unit 404 and stator 450 of sixth tap changing mechanism unit 406.

First sliding contact 430 has a pair of hemispherical contact portions provided so as to sandwich the edge portion of annular conductor 440. These contact portions are locally in surface contact, which is almost in point contact, with annular conductor 440, and therefore exhibit a relatively high electrical resistance and generate relatively high heat during energization.

Second sliding contact 431 has a pair of hemispherical contact portions provided so as to sandwich the edge portion of fixed contact 410. These contact portions are locally in surface contact, which is almost in point contact, with fixed contact 140, and therefore exhibit a relatively high electrical resistance and generate relatively high heat during energization. In addition, second sliding contact 431 is provided so as to be attachable to/detachable from each fixed contact 410.

Movable element 420 is coupled to rotation shaft 41, and pivots about rotation shaft 41 by pivotal movement of rotation shaft 41. Furthermore, movable element 420 has one end coupled to first sliding contact 430 and the other end provided so as to be attachable to/detachable from second sliding contact 431.

In other words, when movable element 420 pivots, second sliding contact 431 is brought into contact with or separated from one of seven fixed contacts 410. Fixed contact 410 in contact with second sliding contact 431 and annular conductor 440 are electrically connected to each other through second sliding contact 731, movable element 720 and first sliding contact 730.

Each of the tap changing mechanism groups includes seven input conductors electrically connected to the fixed contact connection members, respectively, and an output conductor electrically connected to the stator connection member. Each input conductor is electrically connected to the tap of a transformer.

Specifically, one-end side tap changing mechanism group 400*a* includes seven input conductors 408*a* electrically connected to fixed contact connection members 411*a*, respectively, and an output conductor 409*a* electrically connected to stator connection member 451*a*.

The other-end side tap changing mechanism group 400*b* includes seven input conductors 408*b* electrically connected to fixed contact connection members 411*b*, respectively, and an output conductor 409*b* electrically connected to stator connection member 451*b*.

Center line 2*a* of one-end side tap changing mechanism group 400*a* perpendicular to shaft direction 1 of rotation shaft 41 is located between second tap changing mechanism unit 402 and third tap changing mechanism unit 403. Center line 2*b* of the other-end side tap changing mechanism group 400*b* perpendicular to shaft direction 1 of rotation shaft 41 is located between fourth tap changing mechanism unit 404 and fifth tap changing mechanism unit 405.

Center line 3 of entire two tap changing mechanism groups perpendicular to shaft direction 1 of rotation shaft 41 is separated by an interval L2 from each of one-end side tap changing mechanism group 400*a* and the other-end side tap changing mechanism group 400*b*.

In one-end side tap changing mechanism group 400*a*, input connection points 418*a* between seven fixed contact connection members 411*a* and seven input conductors 408*a*, respectively, are located closer in shaft direction 1 of rotation shaft 41 to center line 3 of entire two tap changing mechanism groups than center line 2*a* of one-end side tap changing mechanism group 400*a*. Also in one-end side tap changing mechanism group 400*a*, an output connection point 419*a* between stator connection member 451*a* and output conductor 409*a* is located closer in shaft direction 1 of rotation shaft 41 to center line 3 of entire two tap changing mechanism groups than center line 2*a* of one-end side tap changing mechanism group 400*a*.

In the other-end side tap changing mechanism group 400*b*, input connection points 418*b* between seven fixed contact connection members 411*b* and seven input conductors 408*b*, respectively, are located closer in shaft direction 1 of rotation shaft 41 to center line 3 of entire two tap changing mechanism groups than center line 2*b* of the other-end side tap changing mechanism group 400*b*. Also in the other-end side tap changing mechanism group 400*b*, an output connection point 419*b* between stator connection member 451*b* and output conductor 409*b* is located closer in shaft direction 1 of rotation shaft 41 to center line 3 of entire two tap changing mechanism groups than center line 2*b* of the other-end side tap changing mechanism group 400*b*.

In the present embodiment, each input conductor 408*a* extends from input connection point 418*a* in the direction orthogonal to shaft direction 1 of rotation shaft 41, while output conductor 409*a* extends from output connection point 419*a* in the direction orthogonal to shaft direction 1 of rotation shaft 41.

Each input conductor 408*b* extends from input connection point 418*b* in the direction orthogonal to shaft direction 1 of rotation shaft 41, while output conductor 409*b* extends from output connection point 419*b* in the direction orthogonal to shaft direction 1 of rotation shaft 41.

Figure 19:
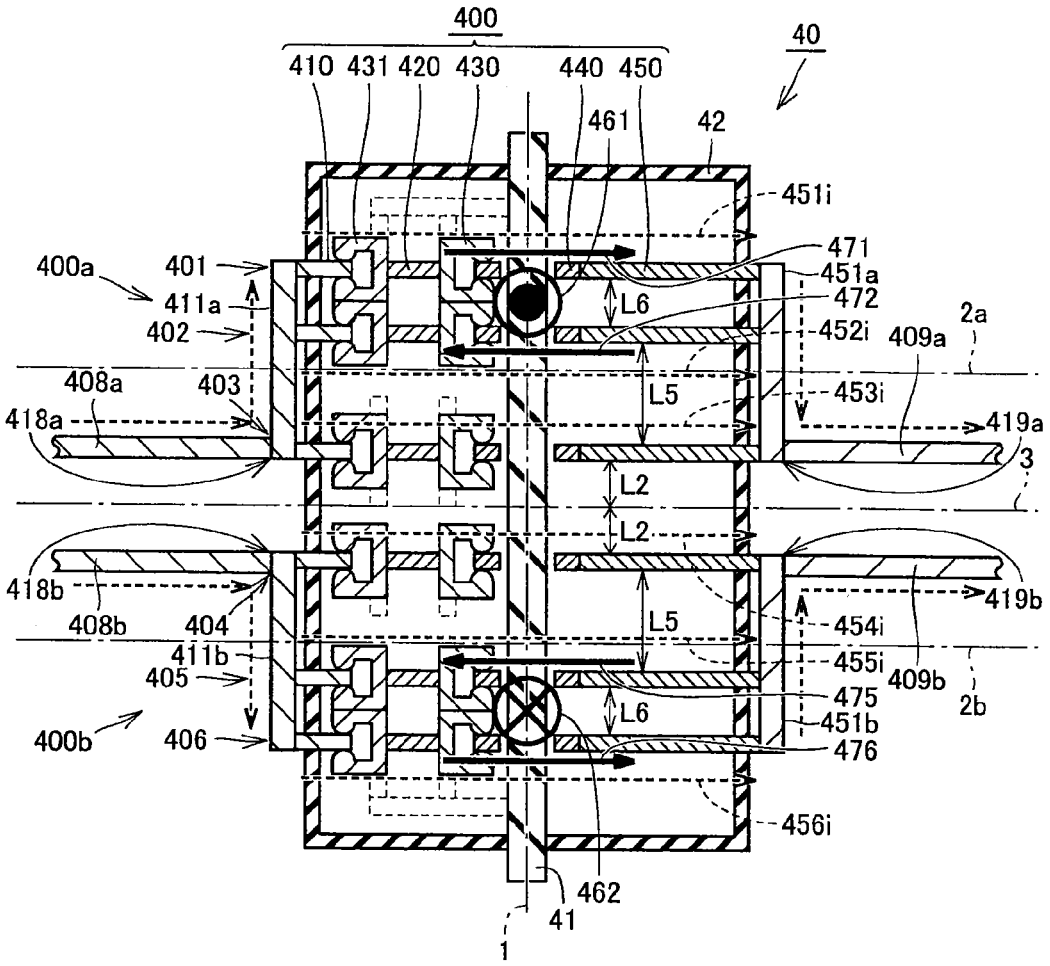
FIG. 19 is a cross-sectional view showing a path of the current flowing through the tap changer according to the fourth embodiment.

FIG. 19 is a cross-sectional view showing a path of the current flowing through the tap changer according to the present embodiment. FIG. 19 shows a current 451*i* flowing from input conductor 408*a* through first tap changing mechanism unit 401 into output conductor 409*a*, a current 452*i* flowing from input conductor 408*a* through second tap changing mechanism unit 402 into output conductor 409*a*, and a current 453*i* flowing from input conductor 408*a* through third tap changing mechanism unit 403 into output conductor 409*a*.

FIG. 19 also shows a current 454*i* flowing from input conductor 408*b* through fourth tap changing mechanism unit 404 into output conductor 409*b*, a current 455*i* flowing from input conductor 408*b* through fifth tap changing mechanism unit 405 into output conductor 409*b*, and a current 456*i* flowing from input conductor 408*b* through sixth tap changing mechanism unit 406 into output conductor 409*b*.

Each path through which current 451*i* and current 456*i* flow is turned and bent so as to produce a bypass, and longer than each linear path through which current 453*i* and current 454*i* flow. Accordingly, the inductance of each path through which current 451*i* and current 456*i* flow is greater than the inductance of each path through which current 453*i* and current 454*i* flow.

Accordingly, the impedance of each path through which current 451*i* and current 456*i* flow with respect to an AC current is greater than the impedance of each path through which current 453*i* and current 454*i* flow. Consequently, it becomes possible to decrease the value of each current flowing through first tap changing mechanism unit 401 and sixth tap changing mechanism unit 406.

As described above, in tap changer 40 according to the present embodiment, interval L6 between first tap changing mechanism unit 401 and second tap changing mechanism unit 402 is smaller than interval L5 between second tap changing mechanism unit 402 and third tap changing mechanism unit 403.

Similarly, interval L6 between fifth tap changing mechanism unit 405 and sixth tap changing mechanism unit 406 is smaller than interval L5 between fourth tap changing mechanism unit 404 and fifth tap changing mechanism unit 405.

Accordingly, the size of the loop formed of first tap changing mechanism unit 401, second tap changing mechanism unit 402, fixed contact connection member 411*a*, and stator connection member 451*a* is reduced, so that a magnetic flux 461 going around so as to cross this loop can be reduced.

Similarly, the size of the loop formed of fifth tap changing mechanism unit 405, sixth tap changing mechanism unit 406, fixed contact connection member 411*b*, and stator connection member 451*b* is reduced, so that a magnetic flux 462 going around so as to cross this loop can be reduced.

Consequently, it becomes possible to reduce the eddy current that produces a magnetic flux in the direction in which this magnetic flux 462 is cancelled out. Specifically, an eddy current 471 generated in first tap changing mechanism unit 401, an eddy current 472 generated in second tap changing mechanism unit 402, an eddy current 475 generated in fifth tap changing mechanism unit 405, and an eddy current 476 generated in sixth tap changing mechanism unit 406 can be reduced.

Therefore, the value of each current flowing through first tap changing mechanism unit 401 and sixth tap changing mechanism unit 406 can be further decreased. By suppressing disproportionate flow of the current in this way, it becomes possible to suppress local overheating occurring at the contact portions in first tap changing mechanism unit 401 and sixth tap changing mechanism unit 406. Consequently, local overheating occurring at the contact portions can be suppressed in entire tap changer 40.

In addition, the number of tap changing mechanism groups included in tap changer 40 is not limited to two, but may be two or more. Furthermore, the number of tap changing mechanism units included in each tap changing mechanism group is not limited to three, but may be three or more.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A tap changer including a plurality of tap changing mechanism groups each having a plurality of tap changing mechanism units that are arranged at predetermined intervals in a shaft direction of a rotation shaft and electrically connected in parallel, said plurality of tap changing mechanism units each comprising:

an annular conductor having the center through which the rotation shaft passes;

a plurality of fixed contacts located at predetermined intervals on a concentric circumference of said rotation shaft;

a stator electrically connected to said annular conductor;

a first sliding contact configured to pivot about said rotation shaft while being in sliding contact with said annular conductor;

a second sliding contact configured to pivot about said rotation shaft to contact one of said plurality of fixed contacts; and a movable element connected between the first sliding contact and second sliding contact and configured to pivot about said rotation shaft together with said first sliding contact and said second sliding contact to connect said annular conductor and one of said plurality of fixed contacts, said plurality of tap changing mechanism groups each including a plurality of fixed contact connection members each configured to electrically connect said fixed contacts that are located at the same position on said concentric circumference as seen in the shaft direction of said rotation shaft in said plurality of tap changing mechanism units, a stator connection member configured to electrically connect the stators of said plurality of tap changing mechanism units, a plurality of input conductors electrically connected to said fixed contact connection members, respectively, and an output conductor electrically connected to said stator connection member, wherein in an end-side tap changing mechanism group of said plurality of tap changing mechanism groups that is located at an end of said rotation shaft, input connection points between said plurality of fixed contact connection members and said plurality of input conductors, respectively, are located closer in the shaft direction of said rotation shaft to a center line of entire said plurality of tap changing mechanism groups than a center line of said end-side tap changing mechanism group, and an output connection point between said stator connection member and said output conductor is located closer in the shaft direction of said rotation shaft to the center line of entire said plurality of tap changing mechanism groups than the center line of said end-side tap changing mechanism group.

2. The tap changer according to claim 1, wherein each of said plurality of tap changing mechanism groups includes three or more said tap changing mechanism units, and in one of said plurality of tap changing mechanism groups, intervals between adjacent said tap changing mechanism units in the shaft direction of said rotation shaft are different.

3. The tap changer according to claim 2, wherein in said end-side tap changing mechanism group, an interval between adjacent said tap changing mechanism units located on an endmost side in the shaft direction of said rotation shaft is smaller than an interval between other adjacent said tap changing mechanism units.

4. The tap changer according to claim 1, wherein in said end-side tap changing mechanism group, said plurality of input conductors extend from said input connection points, respectively, in a direction orthogonal to the shaft direction of said rotation shaft, and said output conductor extends from said output connection point in a direction orthogonal to the shaft direction of said rotation shaft.

* * * * *